US007306887B2

(12) United States Patent
Tanaka et al.

(10) Patent No.: US 7,306,887 B2
(45) **Date of Patent: *Dec. 11, 2007**

(54) TONER AND DEVELOPER FOR ELECTROSTATIC DEVELOPMENT, PRODUCTION THEREOF, IMAGE FORMING PROCESS AND APPARATUS USING THE SAME

(75) Inventors: Chiaki Tanaka, Shizuoka (JP); Takeshi Takada, Shizuoka (JP); Naohiro Watanabe, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 238 days.

This patent is subject to a terminal disclaimer.

(21) Appl. No.: 10/804,082

(22) Filed: Mar. 19, 2004

(65) Prior Publication Data

US 2005/0042534 A1 Feb. 24, 2005

(30) Foreign Application Priority Data

Mar. 19, 2003 (JP) ..... 2003-075883
Mar. 19, 2003 (JP) ..... 2003-076072

(51) Int. Cl.
*G03G 9/08* (2006.01)

(52) U.S. Cl. ..... 430/108.4; 430/109.4

(58) Field of Classification Search ..... 430/108.4, 430/109.4, 137.15, 137.17, 110.3
See application file for complete search history.

(56) References Cited

U.S. PATENT DOCUMENTS

| | | | | |
|---|---|---|---|---|
| 5,976,746 | A | 11/1999 | Tanaka et al. | |
| 6,172,176 | B1 | 1/2001 | Tanaka et al. | |
| 6,187,494 | B1 | 2/2001 | Kawamura et al. | |
| 6,194,535 | B1 | 2/2001 | Katayama et al. | |
| 6,303,736 | B1 | 10/2001 | Kawamura et al. | |
| 6,313,288 | B1 | 11/2001 | Shimada et al. | |
| 6,326,115 | B1 * | 12/2001 | Nakanishi et al. | 430/109.5 |
| 6,465,648 | B1 | 10/2002 | Tadokoro et al. | |
| 6,492,079 | B2 | 12/2002 | Shimada et al. | |
| 6,524,761 | B2 | 2/2003 | Shimada et al. | |
| 6,544,701 | B2 | 4/2003 | Tadokoro et al. | |
| 6,548,216 | B2 | 4/2003 | Kawamura et al. | |
| 6,593,048 | B2 | 7/2003 | Sasaki et al. | |
| 6,596,449 | B2 | 7/2003 | Shimada et al. | |
| 6,653,037 | B2 | 11/2003 | Sawada et al. | |
| 6,660,443 | B2 | 12/2003 | Sugiyama et al. | |
| 6,667,141 | B2 | 12/2003 | Iwamoto et al. | |
| 6,699,632 | B2 | 3/2004 | Higuchi et al. | |
| 6,716,561 | B2 | 4/2004 | Shiraishi et al. | |
| 6,733,939 | B2 | 5/2004 | Nanya et al. | |
| 2003/0027074 | A1 * | 2/2003 | Emoto et al. | 430/124 |
| 2003/0129518 | A1 * | 7/2003 | Sawada et al. | 430/109.4 |
| 2003/0165760 | A1 * | 9/2003 | Higuchi et al. | 430/108.4 |
| 2003/0219670 | A1 * | 11/2003 | Sawada et al. | 430/109.4 |
| 2004/0142264 | A1 * | 7/2004 | Tanaka et al. | 430/108.4 |

FOREIGN PATENT DOCUMENTS

| | | |
|---|---|---|
| JP | 60-90344 | 5/1985 |
| JP | 62-63940 | 3/1987 |
| JP | 64-15755 | 1/1989 |
| JP | 2-82267 | 3/1990 |
| JP | 3-41470 | 2/1991 |
| JP | 3-229264 | 10/1991 |
| JP | 7-152202 | 6/1995 |
| JP | 7-333904 | 12/1995 |
| JP | 8-12475 | 2/1996 |
| JP | 2675948 | 7/1997 |
| JP | 9-251217 | 9/1997 |
| JP | 2931899 | 5/1999 |
| JP | 11-149179 | 6/1999 |
| JP | 11-305486 | 11/1999 |
| JP | 3128907 | 11/2000 |
| JP | 2001-222138 | 8/2001 |

OTHER PUBLICATIONS

U.S. Appl. No. 11/227,215, filed Sep. 16, 2005, Tanaka et al.
U.S. Appl. No. 11/226,357, filed Sep. 15, 2005, Tanaka et al.
U.S. Appl. No. 11/229,748, filed Sep. 20, 2005, Yamashita et al.
U.S. Appl. No. 11/224,976, filed Sep. 14, 2005, Inoue et al.
U.S. Appl. No. 11/196,602, filed Aug. 4, 2005, Ohki et al.
U.S. Appl. No. 11/006,643, filed Dec. 8, 2004, Takada et al.
U.S. Appl. No. 11/016,964, filed Dec. 21, 2004, Ohki et al.
U.S. Appl. No. 10/364,514, filed Feb. 12, 2003, Kawaura et al.
U.S. Appl. No. 10/020,925, filed Dec. 19, 2001, Mochizuki et al.
U.S. Appl. No. 10/086,683, filed Mar. 04, 2002, Matsuda et al.
U.S. Appl. No. 10/101,756, filed Mar. 21, 2002, Matsuda et al.
U.S. Appl. No. 10/077,813, filed Feb. 20, 2002, Higuchi et al.
U.S. Appl. No. 10/059,240, filed Jan. 31,2002, Sugiura et al.
U.S. Appl. No. 10/079,878, filed Feb. 22, 2002, Katoh et al.
U.S. Appl. No. 10/804,082, filed Mar. 19, 2004, Tanaka et al.
U.S. Appl. No. 10/680,246, filed Oct. 8, 2003, Sugiyama et al.
U.S. Appl. No. 10/458,626, filed Jun. 11, 2003, Nagai et al.
U.S. Appl. No. 10/394,265, filed Mar. 24, 2003, Nanya et al.
U.S. Appl. No. 10/286,791, filed Nov. 4, 2002, Yamashita et al.
U.S. Appl. No. 10/247,639, filed Sep. 20, 2002, Sugiyama et al.
U.S. Appl. No. 10/246,601, filed Sep. 19, 2002, Emoto et al.
U.S. Appl. No. 10/284,177, filed Oct. 31, 2002, Tomita et al.
U.S. Appl. No. 10/444,013, filed May 23, 2003, Sawada et al.
U.S. Appl. No. 10/392,894, filed Mar. 21, 2003, Yamashita et al.

(Continued)

*Primary Examiner*—John L Goodrow
(74) *Attorney, Agent, or Firm*—Oblon, Spivak, McClelland, Maier & Neustadt, P.C.

(57) ABSTRACT

A toner is prepared by dissolving and/or dispersing a modified polyester resin in an organic solvent to yield a solution or dispersion, the modified polyester resin being reactive with a compound having an active hydrogen group, mixing the solution or dispersion with an aqueous medium containing resin particles, and subjecting the modified polyester resin to crosslinking and/or elongation in the aqueous medium. The binder resin further includes a crystalline polyester resin in addition to the modified polyester resin.

42 Claims, 2 Drawing Sheets

OTHER PUBLICATIONS

U.S. Appl. No. 10/385,719, filed Mar. 12, 2003, Sugiura et al.
U.S. Appl. No. 10/251,855, filed Sep. 23, 2002, Sawada et al.
U.S. Appl. No. 10/212,736, filed Aug. 7, 2002, Sugiura et al.
U.S. Appl. No. 10/286,816, filed Nov. 4, 2002, Sugiyama et al.
U.S. Appl. No. 10/188,753, filed Jul. 5, 2002, Sugiyama et al.
U.S. Appl. No. 10/092,920, filed Mar. 8, 2002, Yamashita.
U.S. Appl. No. 10/026,746, filed Dec. 27, 2001, Yano et al.
U.S. Appl. No. 10/176,578, filed Jun. 24, 2002, Yagi et al.
U.S. Appl. No. 10/158,069, filed May 31, 2002, Matsuda et al.
U.S. Appl. No. 10/151,103, filed May 21, 2002, Higuchi et al.
U.S. Appl. No. 10/153,627, filed May 24, 2002, Suzuki et al.
U.S. Appl. No. 11/313,817, filed Dec. 22, 2005, Inoue et al.
U.S. Appl. No. 11/520,642, filed Sep. 14, 2006, Tanaka et al.
U.S. Appl. No. 11/519,893, filed Sep. 13, 2006, Inoue et al.
U.S. Appl. No. 11/561,983, filed Nov. 21, 2006, Sugino et al.
U.S. Appl. No. 11/676,883, filed Feb. 20, 2007, Tanaka.
U.S. Appl. No. 11/685,872, filed Mar. 14, 2007, Uchinokura et al.
U.S. Appl. No. 11/687,372, filed Mar. 16, 2007, Yamada et al.
U.S. Appl. No. 11/695,750, filed Apr. 3, 2007, Takada et al.
U.S. Appl. No. 11/685,969, filed Mar. 14, 2007, Uchinokura et al.
U.S. Appl. No. 11/734,895, filed Apr. 13, 2007, Yamashita et al.

* cited by examiner

TONER AND DEVELOPER FOR ELECTROSTATIC DEVELOPMENT, PRODUCTION THEREOF, IMAGE FORMING PROCESS AND APPARATUS USING THE SAME

BACKGROUND OF THE INVENTION

1. Field of the Invention

The present invention relates to a toner, developer, container for a developer and image forming process which are used for developing a latent electrostatic image on a photoconductor to form a visible image in electrophotographic apparatus and electrostatic recording apparatus.

2. Description of the Related Art

In electrophotography, electrostatic recording, and electrostatic printing, a developer is, for example, applied to an latent electrostatic image bearing member such as a photoconductor, so as to dispose the developer onto a latent electrostatic image formed on the latent electrostatic image bearing member in a developing step, the developer disposed on the image is transferred to a recording medium such as a recording paper in a transferring step, thereafter the transferred developer is fixed on the paper in a fixing step. Such developers used for developing the latent electrostatic image formed on the latent electrostatic image bearing member generally include two-component developers comprising a carrier and a toner, and one-component developers such as magnetic toner and non-magnetic toners, which do not require a carrier.

Conventional dry toners for use in electrophotography, electrostatic recording or electrostatic printing are formed by melting and kneading a binder resin such as a styrenic resin or a polyester, a colorant, and other components, then pulverizing the kneaded substance. Although improvement of toners has been attempted by miniaturize a diameter of toner particle in order to obtain high quality images, uniform particle shape cannot be obtained by ordinary manufacturing methods of kneading and pulverization. Moreover, the toner is still pulverized so that excessively toner particles are generated, in a course of mixing with carrier in a developing member of the apparatus, or, by a contact stress between a development roller, and a toner applying roller, a layer thickness controlling blade, or a friction charging blade. These lead to deterioration of image quality. In addition, a superplasticizer embedded in the surface of toner also leads to deterioration of image quality. Further, fluidity of the toner particles is insufficient because of their shapes, and thus a large amount of the superplasticizer is required or a packing fraction of the toner into a toner vessel becomes low. These factors inhibit miniaturization of apparatuses. Advantages of such dry toners having a small particle diameter are not effectively utilized. Toner particles prepared by pulverization have a lower limit of their particle diameter, and those having a further lower particle diameter cannot be obtained by this technique. In addition, such pulverized toner particles have irregular shapes, are not transferred satisfactorily and thereby invite image omission and an increased amount of toner to make up therefor.

Accordingly, a strong demand has arisen to yield high quality images which do not have any missing part and to reduce running cost by further improving transfer efficiency leading to a reduction in toner consumption. If transfer efficiency is remarkably excellent, a cleaning unit, which removes remained toner on a photoconductor or a transfer after transferring, can be omitted from an apparatus. Therefore, the apparatus can be miniaturized and low cost thereof can be achieved together with having a merit of reducing a waste toner. Hence, various methods for manufacturing a spherical toner have been suggested in order to overcome the defects caused by a non-uniformly shaped toner.

However, such spherical toner particles cannot significantly be removed by using a cleaning device such as cleaning blade or brush for removing residual toner from a photoconductor or a transfer medium, thus inviting cleaning failure. The spherical toner particles have their surfaces entirely exposed to surroundings and are thereby susceptible to the contact with a carrier or a charger such as charger blade. An external additive on their surface and a charge control agent located at the outermost surface are often embedded into the toner particles, and the flowability of the toner rapidly decreases, thus deteriorating durability of the toner. Such a dry toner is developed and transferred to a transfer member such as paper and is then fixed by heating and fusing with the use of a heat roll. If the heat roll temperature is excessively high, the toner is excessively fused and thereby adheres to the heat roll (hot offset). If the heat roll temperature is excessively low, the toner is not sufficiently fused, thus inviting insufficient image fixing. For saving energy and for downsizing apparatus, demands have been made on toners having a higher hot offset occurring temperature (higher hot offset resistance) and a lower image-fixing temperature (better low-temperature image-fixing properties). In addition, the toners must have high-temperature storage stability by which they are not blocked in ambient temperature during storage and in apparatus.

As a possible solution to solve these problems, Japanese Patent Application Laid-Open (JP-A) No. 07-152202 proposes a "polymer dissolving-suspending method" accompanying with volume shrinkage. In this method, a toner material is dispersed or dissolved in a volatile solvent such as a low-boiling organic solvent, the dispersion or solution is emulsified in an aqueous medium comprising a dispersing agent to form droplets, and the volatile solvent is removed. In the last process, the droplets undergo volume shrinkage. When a dispersing agent comprising solid particles that are insoluble in the aqueous medium is used, the resulting particles have irregular shapes. When a solid content in the solvent is increased to increase productivity, the disperse phase becomes viscous, and the resulting particles have large particle diameters with a broad distribution. In contrast, when the molecular weight of the resin is decreased to thereby decrease the viscosity of the disperse phase, satisfactory image-fixing properties such as hot offset resistance are not obtained.

JP-A No. 11-149179 proposes an improvement in image-fixing properties, in which a low molecular weight resin is used in the polymer dissolving-suspending method to decrease the viscosity of the disperse phase and facilitate emulsification, and the polymerization is performed within particles. This technique, however, does not improve transfer ability and cleaning ability by controlling the shape of particles.

To support for image-fixing at low temperatures, the use of a polyester resin having excellent low-temperature image-fixing properties and relatively good high-temperature storage stability has been proposed instead of styrene-acrylic resins conventionally used (JP-A No. 60-90344, No. 64-15755, No. 02-82267, No. 03-229264, No. 03-41470 and No. 11-305486). To improve low-temperature image-fixing properties, a specific non-olefinic crystalline polymer that can be fused sharply at its glass transition point is added to the binder (JP-A No. 62-63940). However, this technique does not teach an optimized molecular structure and molecular weight of the polymer. Separately, Japanese Patent (JP-B) No. 2931899 and JP-A No. 2001-222138 disclose the use of a crystalline polyester that can be fused sharply. However, the crystalline polyester in the toner disclosed in JP-B No. 2931899 has a low acid value and hydroxyl value of 5 or less and 20 or less, respectively, has low affinity for paper and thereby fails to provide sufficient low-temperature image-fixing properties. In addition, the molecular structure and molecular weight of the crystalline polyester are not optimized, and the microdomain structure in the toner for exhibiting the sharp melt ability of the crystalline polyester is not disclosed. This technique thus fails to provide sufficient low-temperature image-fixing properties. JP-A No. 2001-222138 also fails to disclose the microdomain structure in the toner for exhibiting the sharp melt ability of the crystalline polyester, thus failing to provide sufficient low-temperature image-fixing properties.

In image-fixing by contact heating, the surface of a heater is brought into contact with a fused toner under pressure (under a load), and the fused toner having a decreased viscoelasticity breaks when peeled off from the roller, and part of the toner image adheres to the surface of the heater and is then transferred to the image upon another contact, thus inviting hot offset. To avoid the hot offset, JP-A No. 09-251217 proposes a binder resin comprising a polyester resin comprising a novolak phenol resin and having satisfactory low-temperature image-fixing properties and hot offset resistance at high temperatures. JP-B No. 02675948 and No. 03128907, JP-A No. 07-333904, and JP-B No. 08-12475 each propose a toner comprising a specific polyester resin as a color toner having excellent hot off-set resistance. These toners, however, cannot produce high-quality sharp images under such conditions as to provide sufficient hot off-set resistance.

OBJECTS AND ADVANTAGES

Accordingly, an object of the present invention is to provide a toner and developer for electrostatic development, a toner container and an image forming process which show excellent low-temperature image-fixing properties and hot off-set resistance.

SUMMARY OF THE INVENTION

After intensive investigations, the present inventors have found that the low-temperature image-fixing properties can be significantly improved by the use of a toner comprising a binder resin comprising a crystalline polyester resin in addition to a modified polyester wherein the toner is prepared by dissolving and/or dispersing in an organic solvent a toner composition comprising the modified polyester reactive with a compound having an active hydrogen group and reacting the solution or dispersion with a crosslinking agent and/or chain extender in an aqueous medium comprising resin particles. They also have found that a toner having satisfactory low-temperature image-fixing properties and good hot off-set resistance can be produced by controlling the crosslinking and/or elongation reaction of the modified polyester resin so as to ensure the resulting toner to have a flow beginning temperature Tfb of 70° C. to 150° C. In addition, they have found that the low-temperature image-fixing properties are significantly improved by controlling the diameter of dispersed particles of the crystalline polyester resin in the toner. The present invention has been accomplished based on these findings.

Specifically, the present invention provides the following toner, developer, toner container and image forming process.

Namely, the present invention provides, in a first aspect, a toner for electrostatic development comprising toner particles, each comprising a colorant and a binder resin. The binder resin comprises a modified polyester resin and a crystalline polyester resin. Such toner particles are obtained by the process comprising the steps of: subjecting the modified polyester resin to dissolving and/or dispersing in an organic solvent to yield a solution or dispersion, the modified polyester resin being reactive with a compound having an active hydrogen group; mixing the solution or dispersion with an aqueous medium comprising resin particles; and subjecting the modified polyester resin to crosslinking and/or elongation in the aqueous medium.

The second aspect of the present invention is the toner according to the first aspect, wherein the binder resin comprises the modified polyester resin (i), an unmodified polyester resin (ii), and the crystalline polyester resin (iii). The weight ratio of the modified polyester resin (i) to the total of the unmodified polyester resin (ii) and the crystalline polyester resin (iii) is from 5/95 to 25/75, and the weight ratio of the unmodified polyester resin (ii) to the crystalline polyester resin (iii) is from 99/1 to 50/50.

The third aspect of the present invention is the toner according to the first aspect, wherein the toner has a glass transition point Tg of 40° C. to 70° C.

The fourth aspect of the present invention is the toner according to the first aspect, wherein the toner has a flow beginning temperature Tfb of 70° C. to 150° C.

The fifth aspect of the present invention is the toner according to the first aspect, wherein the toner particles preferably have a volume-average particle diameter of 4 μm to 8 μm.

The sixth aspect of the present invention is the toner according to the first aspect, wherein the toner particles have a volume-average particle diameter Dv and a number-average particle diameter Dn, and the ratio Dv/Dn of Dv to Dn is preferably from 1.00 to 1.25.

The seventh aspect of the present invention is the toner according to the first aspect, wherein the toner particles have an average sphericity of 0.95 to 0.99.

The eighth aspect of the present invention is the toner according to the first aspect, wherein, in a molecular weight distribution of tetrahydrofuran (THF)-soluble components of the polyester resins in the toner, the peak molecular weight is 1,000 to 30,000, the content of a component having a molecular weight of 30,000 or more is 1% by volume to 80% by volume, and the number-average molecular weight is from 2,000 to 15,000.

The ninth aspect of the present invention is the toner according to the eighth aspect, wherein, in a molecular weight distribution of tetrahydrofuran (THF) soluble components of the polyester resins in the toner, the content of a component having a molecular weight of 1,000 or less is preferably from 0.1% by volume to 5.0% by volume.

The tenth aspect of the present invention is the toner according to the eighth aspect, wherein the content of tetrahydrofuran-insoluble components in the polyester resins in the toner is preferably from 1% by volume to 15% by volume.

The eleventh aspect of the present invention is the toner according to the first aspect, wherein the resin particles have a volume-average particle diameter of 5 nm to 500 nm.

The twelfth aspect of the present invention is the toner according to the first aspect, wherein the toner further comprises a releasing agent. The releasing agent is a wax immiscible with the binder resin.

The thirteenth aspect of the present invention is the toner according to the twelfth aspect, wherein the wax is a polyalkanoic acid ester.

The fourteenth aspect of the present invention is the toner according to the first aspect, wherein the toner further comprises a lubricant which is capable of controlling the miscibility of the crystalline polyester resin with the other component of the binder resin.

The fifteenth aspect of the present invention is the toner according to the fourteenth aspect, wherein the lubricant is at least one selected from montanic acid wax, montanic ester wax and partially saponified ester wax.

The sixteenth aspect of the present invention is the toner according to the first aspect, wherein the toner further comprises a charge control agent.

The seventeenth aspect of the present invention is the toner according to the first aspect, wherein the crystalline polyester resin is dispersed in the toner particle as particles having a major axis of 0.2 μm to 3.0 μm.

The eighteenth aspect of the present invention is the toner according to the first aspect, wherein the crystalline polyester resin has an endothermic peak temperature in differential scanning calorimetry (DSC) of 50° C. to 150° C.

The nineteenth aspect of the present invention is the toner according to the first aspect, wherein, in a molecular weight distribution determined by gel permeation chromatography (GPC), an o-dichlorobenzene-soluble component in the crystalline polyester resin has a weight-average molecular weight Mw of 1,000 to 6,500, a number-average molecular weight Mn of 500 to 2,000, and a ratio Mw/Mn of Mw to Mn of 2 to 5.

The twentieth aspect of the present invention is the toner according to the nineteenth aspect, wherein the weight-average molecular weight Mw is 5,500 to 6,500, the number-average molecular weight Mn is 1,300 to 1,500, and the ratio Mw/Mn is from 2 to 5.

The twenty-first aspect of the present invention is the toner according to the first aspect, wherein the crystalline polyester resin is preferably one represented by following Formula (1):

$$-[O-CO-CR_1=CR_2-CO-O-(CH_2)_n]- \quad (1)$$

wherein $R_1$ and $R_2$ are each a hydrocarbon group having 1 to 20 carbon atoms.

The twenty-second aspect of the present invention is the toner according to the first aspect, wherein the crystalline polyester resin comprises an alcohol component and an acid component, wherein the alcohol component comprises a diol compound having 2 to 6 carbon atoms and the acid component comprises at least one selected from the group consisting of maleic acid, fumaric acid, succinic acid and derivatives of them as an acid component.

The twenty-third aspect of the present invention is the toner according to the twenty-second aspect, wherein the crystalline polyester resin comprises at least one selected from 1,4-butanediol, 1,6-hexanediol and derivatives of them as an alcohol component.

The twenty-fourth aspect of the present invention is the toner according to the first aspect, wherein the crystalline polyester resin have a glass transition point Tg of 30° C. to 130° C. and $F_{1/2}$ temperature of 60° C. to 130° C.

The twenty-fifth aspect of the present invention is the toner according to the first aspect, wherein the crystalline polyester resin has an acid value of 20 mgKOH/g to 45 mgKOH/g.

The twenty-sixth aspect of the present invention is the toner according to the first aspect, wherein the crystalline polyester resin has a hydroxyl value of 5 mgKOH/g to 50 mgKOH/g.

The twenty-seventh aspect of the present invention is the toner according to the first aspect, wherein the crystalline polyester resin may show diffraction peaks at least at points of 2θ of 19° to 20°, 21° to 22°, 23° to 25°, and 29° to 31°, in an X-ray diffraction pattern determined with an X-ray powder diffractometer.

The twenty-eighth aspect of the present invention is the toner according to the first aspect, wherein the modified polyester resin reactive with a compound having an active hydrogen group is a modified polyester resin capable of having a urea bond.

The twenty-ninth aspect of the present invention is the toner according to the first aspect, wherein the process further comprises the steps of removing the organic solvent with an application at least one of reduced pressure and heat.

The thirtieth aspect of the present invention is the toner according to the first aspect, wherein the process further comprises the steps of dispersing the crystalline polyester resin in an organic solvent as particles having a volume-average particle diameter of 0.2 μm to 3 μm to yield a dispersion, and mixing the dispersion with the aqueous medium together with the modified polyester resin reactive with a compound having an active hydrogen group.

The thirty-first aspect of the present invention is the toner according to the first aspect, wherein the process comprises the steps of: dissolving or dispersing the colorant in an organic solvent to yield a solution or dispersion; and mixing the solution or dispersion with the aqueous medium together with the modified polyester resin reactive with a compound having an active hydrogen group.

The thirty-second aspect of the present invention is the toner according to the thirty-first aspect, wherein the process comprises the steps of: kneading the colorant and at least part of the binder resin with water to yield a composition; dissolving or dispersing the composition in an organic solvent to yield a solution or dispersion; and mixing the solution or dispersion with the aqueous medium.

The thirty-third aspect of the present invention is the toner according to the first aspect, wherein the colorant is dispersed in the toner particles as particles having a number-average particle diameter of 0.5 μm or less, in which the content of colorant particles having a number-average particle diameter of 0.7 μm or more is 5% by number or less.

The thirty-fourth aspect of the present invention is the toner according to the second aspect, wherein the unmodified polyester resin (ii) has a glass transition point Tg of 40° C. to 80° C.

The thirty-fifth aspect of the present invention is the toner according to the second aspect, wherein the unmodified polyester resin (ii) has a weight-average molecular weight of 2,000 to 90,000.

The thirty-sixth aspect of the present invention is the toner according to the twelfth aspect, wherein the wax has a melting point of 40° C. to 160° C.

The thirty-seventh aspect of the present invention is the toner according to the first aspect, wherein the toner particle comprises an external additive which is at least one of inorganic particles and resin particles.

The thirty-eighth aspect of the present invention is a process for producing a toner for electrostatic development, wherein the process comprises the steps of: mixing an aqueous medium comprising resin particles with (1) an organic solvent comprising a modified polyester resin dissolved and/or dispersed therein, in which the modified polyester rein is reactive with a compound having an active hydrogen group, (2) an organic solvent comprising a crystalline polyester resin dispersed therein as particles having a volume-average particle diameter of 0.2 μm to 3 μm, and (3) an organic solvent comprising a colorant dissolved or dispersed therein; subjecting the modified polyester resin to crosslinking and/or elongation in the aqueous medium; and removing the organic solvents The thirty-ninth aspect of the present invention is a one-component developer wherein the one-component developer comprises the toner of the present invention.

The fortieth aspect of the present invention is a two-component developer wherein the two-component developer comprises a carrier and the toner of the present invention.

The forty-first aspect of the present invention is a container for a developer, wherein the container houses the toner of the present invention.

The forty-second aspect of the present invention is an image forming process, wherein the image forming process comprises the steps of: charging a photoconductor; irradiating the photoconductor with imagewise light so as to form a latent electrostatic image thereon; developing the latent electrostatic image with a toner so as to form a toner image; transferring the toner image from the photoconductor to a recording material; and heating and pressing the transferred image with a fixing member so as to fix the image on the recording material. In the process, the fixing member is one of a roller and a belt and the toner is the toner of the present invention.

Further objects, features and advantages of the present invention will become apparent from the following description of the preferred embodiments with reference to the attached drawings.

DESCRIPTION OF THE PREFERRED EMBODIMENTS

Advantages of Crystalline Polyester Resin

Figure 1:
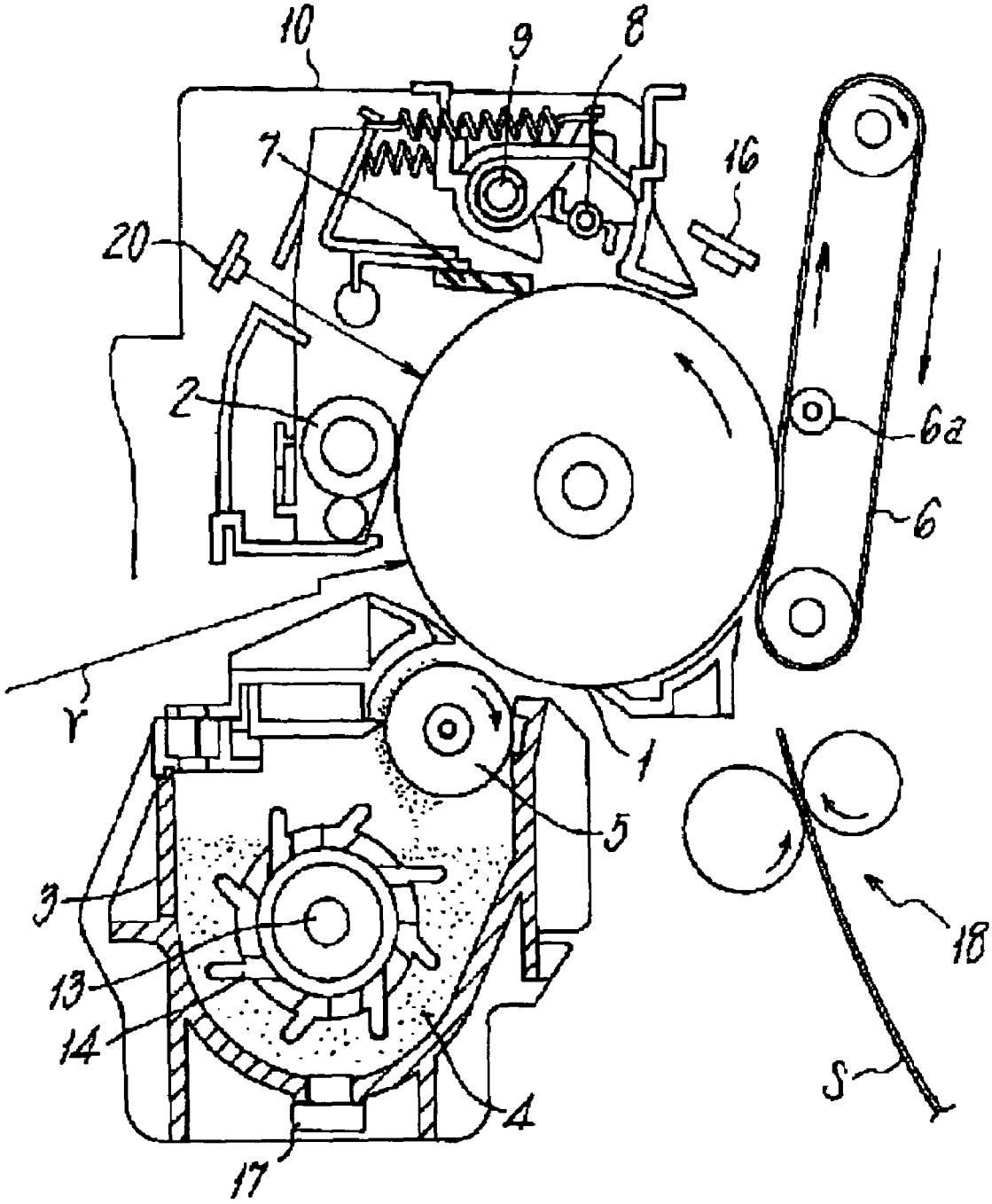
FIG. 1 is a schematic diagram showing one example of an image-forming process and apparatus of the present invention.

Owing to its crystallinity, the crystalline polyester resin in the toner of the present invention shows a sharp drop in its viscosity at around the fixing beginning temperature (melt-starting temperature).

More specifically, the crystalline polyester resin shows good high-temperature storage stability due to its crystallinity below the melt-starting temperature, has a sharply dropped viscosity, is sharply fused and is fixed at the melt-starting temperature. Thus, it can provide a toner having well-balanced high-temperature storage stability and low-temperature image-fixing properties.

In addition, the resulting toner has a wide releasing margin, i.e., a large difference between the lowest image-fixing temperature and the hot offset occurring temperature.

Sphericity and Sphericity Distribution

The toner of the present invention preferably has a specific shape and specific distribution in shape. A toner having an average sphericity of less than 0.95 and having an irregular shape apart from sphere may not produce sufficient transfer ability and high-quality images without scattering of toner particles (dust). The sphericity of the dry toner is preferably determined by an optical detection band method, wherein a particle-containing suspension is allowed to pass through a photographic detection band on a plate, and the particle images are optically detected and analyzed with a CCD camera. The average sphericity is determined by dividing a boundary length of a corresponding circle having an equal projected area by a boundary length of the measured particle. The present inventors have found that a toner having an average sphericity of from 0.95 to 0.99 is effective to produce images with an appropriate density and high precision and reproducibility. The average sphericity of the toner is from 0.95 to 0.99 and further preferably from 0.96 to 0.99. The content of particles having a sphericity of less than 0.96 in the toner is preferably 10% by number or less. A toner having an average sphericity exceeding 0.991 may invite cleaning failure of a photoconductor and/or transfer belt and thereby stain or deposition of toner particles on images in a system employing, for example, blade cleaning. In development and transfer of an image with a low image occupancy, the amount of a residual toner after transfer is small and the cleaning failure does not become a problem. However, in development and transfer of an image with a high image occupancy or in the case that an untransferred toner constituting an image remains on the photoconductor, the cleaning failure leads to toner deposition on the background of images. In addition, such a residual toner may be deposited on a charger roller for contact-charging the photoconductor and other members, thus reducing the inherent charging ability. The sphericity is determined as the sphericity on average by a flow particulate image analyzer FPIA-1000 (trade name, available from Sysmex Corporation). Specifically, the measurement is performed by adding 0.1 ml to 0.5 ml of a surfactant such as an alkylbenzene sulfonate as a dispersing agent to 100 ml to 150 ml of water in a vessel from which solid impurities have been removed, and then adding approximately 0.1 g to 0.5 g of the test sample. The suspension, in which the test sample is dispersed, is subjected to dispersion treatment for approximately 1 minute to 3 minutes by an ultrasonic disperser, and the shape and distribution of the toner particles are determined by the above apparatus at a dispersion concentration of 3,000 particles per microliter to 10,000 particles per microliter.

Particle Diameter Distribution Dv/Dn

The toner has a volume-average particle diameter Dv of preferably from 4 μm to 8 μm and a ratio Dv/Dn of its volume-average particle diameter Dv to its number-average particle diameter Dn of preferably 1.00 to 1.25, and more preferably 1.05 to 1.20, from the viewpoints of excellent heat-resistant storability, image-fixing properties at low temperatures, and hot offset resistance. By satisfying the above-mentioned preferred ranges, especially glossiness of an image becomes excellent when the toner is used in a full-color copier. Further, when the toner is used in a two-component developer, variation of the toner particle diameter is minimized even after repeating cycles of consumption and addition of the toner with respect to carrier. As the toner keeps a narrow average particle diameter distribution without being affected by stirring in a developing device for a long period, the developer can keep stable and excellent developing properties. When the toner is used as a one-component developer, the variation of the toner particle diameter is minimized as in the two-component developer. In addition, filming of the toner to a developing roller, and toner fusion to members such as toner blade which controls the toner thickness on the developing roller are also prevented. Hence, even if the toner is used (stirred) in the developing device for a long period of time, the toner can keep stable and excellent developing properties to form high-quality images.

It is generally believed that a smaller particle diameter of a toner can yield an image with a higher resolution and higher quality. However, an excessively small particle diameter adversely affects the transfer ability and cleaning ability. If a toner having a volume-average particle diameter Dv less than 4.0 μm is used in a two-component developer, the toner fuses and adheres to the carrier surface during long-term agitation in a development device to thereby decrease charge ability of the carrier. If such a toner is used in a one-component developer, the toner may invite filming to a development roller or adhesion to another member such as blade for thinning the toner layer.

These are also true in a toner containing a large amount of particles having an excessively small diameter.

If the volume-average particle diameter Dv of the toner is more than 8.0 mm, the toner may not significantly yield high-quality images with a high resolution and may often show large variation in its particle diameter after consumption and addition of the toner in the developer. This is also true if the ratio Dv/Dn exceeds 1.25.

The present inventors have also found that a toner having a ratio Dv/Dn of less than 1.00 may not be charged sufficiently or may not be cleaned satisfactorily, although it behaves stably and is charged uniformly.

Modified Polyester Resin

Examples of the modified polyester resin (i) are polyester prepolymers modified typically with isocyanate or epoxy group. The modified polyester resin (i) undergoes an elongation reaction with a compound having an active hydrogen group, such as an amine, and thereby works to improve the releasing margin, i.e. to provide a large difference between the lowest image-fixing temperature and the hot offset occurring temperature. The modified polyester resin (i) can be easily prepared by reacting a base polyester resin with a conventional isocyanating agent or epoxidizing agent. The isocyanate-containing polyester prepolymer (A) can be prepared by allowing a polyester as a polycondensate between a polyhydric alcohol (PO) and a polycarboxylic acid (PC) and having an active hydrogen group to react with a polyisocyanate compound (PIC). The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

These modified polyesters (MPE) such as urea-modified polyesters each have an easily controllable molecular weight of polymeric component and are advantageous to ensure dry toners to have good low-temperature image-fixing properties especially in oil-less fixing systems, namely, wide releasing properties and satisfactory image-fixing properties in systems without an application mechanism for applying a releasing oil to an image-fixing heating medium. In particular, polyester prepolymers having a urea-modified terminal show less adhesion to the image-fixing heating medium while keeping high flowability and optical transparency at image-fixing temperatures derived from the original unmodified polyester resin.

Examples of the polyol (PO) include diols (DIO) and trihydric or higher polyols (TO). As the polyol (PO), a diol (DIO) alone or a mixture of a diol (DIO) and a small amount of a polyol (TO) is preferred.

Examples of the diols include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred. The trihydric or higher polyols (TO) include, for example, trihydric or higher aliphatic alcohols such as glycerol, trimethylolethane, trimethylolpropane, pentaerythritol, and sorbitol; trihydric or higher phenols such as trisphenol PA, phenol novolacs, and cresol novolacs; and alkylene oxide adducts of these trihydric or higher polyphenols.

The polycarboxylic acid (PC) includes, for example, dicarboxylic acids (DIC) and tri- or higher polycarboxylic acids (TC). As the polycarboxylic acid (PC), a dicarboxylic acid (DIC) alone or in combination with a small amount of a tri- or higher polycarboxylic acid (TC) is preferred. The dicarboxylic acids include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms. The tri- or higher polycarboxylic acids include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid to react with the polyol. The ratio of the polyol (PO) to the polycarboxylic acid (PC) in terms of the equivalence ratio [OH]/[COOH] of the hydroxyl groups [OH] to the carboxyl groups [COOH] is generally from 2/1 to 1/1, preferably from 1.5/1 to 1/1, and more preferably from 1.3/1 to 1.02/1.

The polyisocyanate includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as α,α,α',α'-tetramethylxylylene diisocyanate; isocyanurates; blocked products of the polyisocyanates with, for example, phenol derivatives, oximes, or caprolactams; and mixtures of these compounds. A typical example of the epoxidizing agent is epichlorohydrin.

The equivalence ratio [NCO]/[OH] of isocyanate groups [NCO] to hydroxyl groups [OH] of the hydroxyl-containing polyester is generally from 5/1 to 1/1, preferably from 4/1 to 1.2/1, and more preferably from 2.5/1 to 1.5/1. If the ratio

[NCO]/[OH] is more than 5, the toner may have insufficient image-fixing properties at low temperatures. If the ratio [NCO/[OH] is less than 1, a urea content in the modified polyester decreases, and thus the toner may have deteriorated hot offset resistance. The polyisocyanate content of the modified polyester resin is generally from 0.5% by weight to 40% by weight, preferably from 1% by weight to 30% by weight and more preferably from 2% by weight to 20% by weight. If the content is less than 0.5% by weight, the hot off-set resistance may deteriorate, and satisfactory storage stability at high temperatures and image-fixing properties at low temperatures may not be obtained concurrently. If the content is more than 40% by weight, the image-fixing properties at low temperatures may deteriorate.

The polyester prepolymer (A) has, in average, 1 or more, preferably 1.5 to 3, and more preferably 1.8 to 2.5 isocyanate groups per molecule. If the amount of the isocyanate group per molecule is less than 1, the resulting urea-modified polyester may have a low molecular weight and the hot off-set resistance may deteriorate.

The amine includes, for example, diamines, tri- or higher polyamines, amino alcohols, aminomercaptans, amino acids, and amino-blocked products of these amines. The diamines include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine. The tri- or higher polyamines include, for example, diethylenetriamine, and triethylenetetramine. The amino alcohols include, but are not limited to, ethanolamine, and hydroxyethylaniline. The aminomercaptans include, for example, aminoethyl mercaptan, and aminopropyl mercaptan. The amino acids include, but are not limited to, aminopropionic acid, and aminocaproic acid. The amino-blocked products of the amines include ketimine compounds and oxazoline compounds derived from the amines and ketones such as acetone, methyl ethyl ketone, and methyl isobutyl ketone. Among these amines, preferred are the diamine alone or in combination with a small amount of the polyamine. These amines can also be used as the crosslinking agent and/or chain extender.

Where necessary, the molecular weight of the urea-modified polyester can be controlled by using an elongation terminator. Such elongation terminators include, but are not limited to, monoamines, such as diethylamine, dibutylamine, butylamine, and laurylamine; and blocked products thereof such as ketimine compounds.

The content of the amine in terms of the equivalence ratio [NCO]/[NHx] of isocyanate groups [NCO] in the urea-modified polyester to amino groups [NHx] of the amine is generally from 1/2 to 2/1, preferably from 1.5/1 to 1/1.5 and more preferably from 1.2/1 to 1/1.2. If the ratio [NCO]/[NHx] is more than 2/1 or is less than 1/2, the urea-modified polyester may have a low molecular weight, and the hot off-set resistance may deteriorate. The urea-modified polyester for use in the present invention may have a urethane bond in addition to the urea bond. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot off-set resistance may deteriorate.

The urea-modified polyester after elongation reaction for use in the present invention can be prepared, for example, by a one-shot method or a prepolymer method. The weight-average molecular weight of the urea-modified polyester is generally $1\times10^4$ or more, preferably from $2\times10^4$ to $1000\times10^4$, and more preferably from $3\times10^4$ to $100\times10^4$. If the weight-average molecular weight is less than $1\times10^4$, the hot offset resistance may deteriorate. The number-average molecular weight of the modified polyester is not specifically limited when an unmodified polyester mentioned later is used in combination and may be such a number-average molecular weight as to yield the above-specified weight-average molecular weight. If the modified polyester is used alone, the number-average molecular weight thereof is 20,000 or less, preferably from 1,000 to 10,000, and more preferably from 2,000 to 8,000. If the number-average molecular weight is more than 20,000, the image-fixing properties at low temperatures and glossiness upon use in a full-color apparatus may deteriorate.

Unmodified Polyester

The toner may further comprise an unmodified polyester resin (ii) as the binder resin component in addition to the modified polyester resin (i) and the crystalline polyester resin (iii). The combination use of the modified polyester resin (i) with the unmodified polyester resin (ii) can further increase low-temperature image-fixing properties and improve gloss when used in a full-color apparatus and is more preferred than the single use of the modified polyester resin (i). These polyester resins (i) and (ii) are preferably at least partially compatible or miscible with each other for better low-temperature image-fixing properties and hot off-set resistance. Accordingly, the unmodified polyester resin (ii) preferably has a composition similar to that of the modified polyester resin (i).

The peak molecular weight of the unmodified polyester resin (ii) is generally from 1,000 to 30,000, preferably from 1,500 to 10,000, and more preferably from 2,000 to 8,000. If the peak molecular weight is less than 1,000, the storage stability at high temperatures may deteriorate, and if it is more than 30,000, the image-fixing properties at low temperatures may deteriorate. The hydroxyl value of the unmodified polyester resin (ii) is preferably 5 or more, more preferably from 10 to 120, and typically preferably from 20 to 80. If the hydroxyl value is less than 5, satisfactory storage stability at high temperatures and image-fixing properties at low temperatures may not be obtained concurrently. The acid value of the unmodified polyester resin (ii) is generally from 1 mgKOH/g to 30 mgKOH/g, and preferably from 5 mgKOH/g to 20 mgKOH/g. A binder having such an acid value may be often negatively charged. An unmodified polyester resin having an acid value and/or hydroxyl value exceeding the above ranges is susceptible to the environment at high temperatures and high humidity or at low temperatures and low humidity, thus inviting deteriorated images.

Crystalline Polyester Resin

The crystalline polyester resin is a polyester resin having at least a melting point.

Preferred examples of the crystalline polyester resin (iii) are crystalline polyester resins which are prepared synthetically by the use of an alcohol component and an acid component. The alcohol components are, for example, a diol compound having 2 to 6 carbon atoms and the like. Preferably, the alcohol component is at least one of 1,4-butane diol, 1,6-hexane diol and derivatives thereof. The acid component is preferably at least one of maleic acid, fumaric acid, succinic acid and derivatives thereof. Preferred examples of the crystalline polyester resin (iii) have a constitutional repeating unit represented by following Formula (1):

$$-[O-CO-CR_1=CR_2-CO-O-(CH_2)_n]- \quad (1)$$

wherein $R_1$ and $R_2$ are each independently a hydrocarbon group having 1 to 20 carbon atoms.

To control the crystallinity and softening point of the crystalline polyester resin (iii), a non-linear polyester can be used. Such non-linear polyester can be prepared by further adding a trihydric or higher polyhydric alcohol such as glycerol as an alcohol component and/or a trivalent or higher polycarboxylic acid such as trimellitic anhydride as an acid component in the polycondensation.

The molecular structure of the crystalline polyester can be determined typically by solid NMR such as solid $C^{13}$-NMR. The present inventors have made intensive investigations from the viewpoint that a crystalline polyester having a sharp molecular weight distribution and a low molecular weight shows excellent low-temperature image-fixing properties. As a result, they have found that the crystalline polyester resin (iii) preferably has a peak at 3.5 to 4.0, a half-width of peak of 1.5 or less, a weight-average molecular weight Mw of 1,000 to 6,500, a number-average molecular weight Mn of 500 to 2,000 and a ratio Mw/Mn of 2 to 5 in a molecular weight distribution of components soluble in o-dichlorobenzene with the abscissa of log (molecular weight M) and the ordinate of percent by weight determined by gel permeation chromatography (GPC). They also have found that the melting temperature and $F_{1/2}$ temperature of the crystalline polyester resin (iii) are preferably as low as possible within ranges not deteriorating the high-temperature storage stability. Here, the $F_{1/2}$ temperature is a melting temperature (point) determined by the ½method. If the melting temperature and $F_{1/2}$ temperature are lower than 50° C., the high-temperature storage stability may be deteriorated, thus often inviting blocking at temperatures in the developing device. If they are higher than 130° C., the resulting toner may have an elevated lowest image-fixing temperature, thus deteriorating the low-temperature image-fixing properties.

The acid value of the crystalline polyester resin (iii) is preferably 8 mgKOH/g or more and more preferably 20 mgKOH/g or more for better affinity for paper and for satisfactory low-temperature image-fixing properties. It is preferably 45 mgKOH/g or less for better hot off-set resistance. The hydroxyl value of the crystalline polyester resin (iii) is preferably 0 to 50 mgKOH/g and more preferably 5 to 50 mgKOH/g for sufficient low-temperature image-fixing properties and better electrostatic properties.

An aliphatic crystalline polyester having a low molecular weight undergoes crystalline transformation, shows sharp drop of melt viscosity upon the transformation from the solid state and can be fixed to paper at the glass transition point Tg. Accordingly, the lowest image-fixing temperature of the toner can be controlled by controlling the glass transition point Tg and $F_{1/2}$ temperature of the crystalline polyester. Specifically, by controlling the glass transition point Tg and $F_{1/2}$ temperature of the crystalline polyester within a range of 30° C. to 130° C., unprecedented excellent low-temperature image-fixing properties can be obtained. The binder resin more preferably has a sea-and-island phase-separation structure comprising the crystalline polyester and a binder resin which has a higher molecular weight and higher $F_{1/2}$ temperature than the crystalline polyester and is immiscible with the crystalline polyester. The binder resin having a higher $F_{1/2}$ temperature works to increase the elasticity of the toner and thus contributes to higher hot off-set resistance. The phase-separation structure allows the individual phases, i.e., the individual resins to exhibit their inherent properties to thereby ensure satisfactory low-temperature image-fixing properties and wide ranges of image-fixing temperatures. An excessively large ratio of the island component in the phase-separation structure may invite deteriorated high-temperature storage stability or deposition of toner particles on the surface of carrier and decreased electrostatic properties of the carrier. In addition, if such a binder resin is used in a one-component developer, the toner may often deposit on members such as developing rollers and toner-thickness-regulating blades. In contrast, if a ratio of the island component is excessively small or a phase-separation structure is not formed, sufficient low-temperature image-fixing properties may not be obtained. Thus, the toner should preferably have an appropriate phase-separation structure for satisfactory properties. The formation of the phase-separation structure can be verified by observation of the cross-section of the toner particles with a transmission electron microscope (TEM). More specifically, the phase-separation structure can be verified by TEM observation that the cross section has islands where the colorant is not present, since the colorant is selectively dispersed not into the crystalline polyester but into the binder resin.

The crystallinity of the crystalline polyester can be verified by the presence of diffraction peaks at points of 2θ: 19° to 20°, 21° to 22°, 23° to 25°, and 29° to 31°, in an X-ray diffraction pattern determined with an X-ray powder diffractometer.

For satisfactory low-temperature image-fixing properties of the toner, the weight ratio of the modified polyester resin (i) to the total of the unmodified polyester resin (ii), if any, and the crystalline polyester resin (iii) is generally from 5/95 to 25/75, preferably 10/90 to 25/75, more preferably from 12/88 to 25/75 and typically preferably from 12/88 to 22/78; and the weight ratio of the unmodified polyester resin (ii) to the crystalline polyester resin (iii) is generally from 99/1 to 50/50, preferably from 95/5 to 60/40, and more preferably from 90/10 to 65/35. With the weight ratios out of the above ranges, the hot off-set resistance may be deteriorated, and well-balanced high-temperature storage stability and low-temperature image-fixing properties may not be obtained.

The glass transition point Tg of the binder resin for use in the present invention is generally from 40° C. to 70° C., and preferably from 40° C. to 65° C. If the glass transition point is less than 40° C., the heat storage stability of the toner may deteriorate, and if it is higher than 70° C., the image-fixing properties at low temperatures may be insufficient. By using the urea-modified polyester resin, the toner for electrostatic development according to the present invention, even with a low glass transition point, shows higher heat storage stability than conventional polyester toners. The storage elastic modulus of the binder resin is such that the temperature TG', at which the storage elastic modulus determined at 20 Hz is 10,000 dyne/$cm^2$, is 100° C. or higher, and preferably from 110° C. to 200° C. If the temperature TG' is lower than 100° C., the hot offset resistance may deteriorate. The temperature Tη, at which the viscosity of the binder resin is 1,000 poises as determined at 20 Hz, is 180° C. or lower, and preferably from 90° C. to 160° C. If the temperature Tη is higher than 180° C., the image-fixing properties at low temperatures may deteriorate. To obtain satisfactory image-fixing properties at low temperatures and hot offset resistance concurrently, TG' is preferably higher than Tη. In other words, the difference between TG' and Tη

(TG'-Tη) is preferably 0° C. or more, more preferably 10° C. or more, and typically preferably 20° C. or more. The upper limit of the difference is not specifically limited. To obtain satisfactory heat storage stability and image-fixing properties at low temperatures concurrently, the difference between Tη and Tg is preferably from 0° C. to 100° C., more preferably from 10° C. to 90° C., and typically preferably from 20° C. to 80° C.

Colorant

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The colorant content of the toner is generally from 1% by weight to 15% by weight, and preferably from 3% by weight to 10% by weight.

A colorant for use in the present invention may be a master batch prepared by mixing and kneading a pigment with a resin.

Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste comprising the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

The organic solvent can be any of conventional organic solvents, as long as it can dissolve the binder resins satisfactorily, of which acetone, toluene and butanone are preferred for better dispersion of the colorant. When prepared by this method, a color toner contains particles of the colorant having a smaller particle diameter and being uniformly dispersed. The color toner can thereby produce a projection image by overhead projector (OHP) with colors more satisfactorily reproduced. In addition, the wax immiscible with and thereby dispersed in the binder resin bleeds out from the surface of toner particles and exhibits sufficient hot off-set resistance even when an oil is not applied to the image-fixing member. In this connection, a wax miscible with the binder resin may not effectively bleed out upon image-fixing and thus may often invite hot offset.

The number-average particle diameter of the colorant for use in the toner is preferably 0.5 μm or less, more preferably 0.4 μm or less and further preferably 0.3 μm or less.

A colorant having a number-average particle diameter exceeding 0.5 μm may not sufficiently be dispersed, and the target optical transparency may not be obtained even using the specific resins and colorant having a specific particle diameter.

It is believed that a colorant in the form of particles having a particle diameter less than 0.1 μm does not adversely affect optical reflection and absorption. Such colorant particles having a particle diameter less than 0.1 μm contribute better color reproducibility and higher transparency of an OHP sheet bearing a fixed image. In contrast, a large amount of colorant particles having a particle diameter exceeding 0.5 μm may deteriorate the lightness and chroma of the projection image of such an OHP sheet.

In addition, a colorant including a large amount of colorant particles having a particle diameter exceeding 0.5 μm may be easily flaked off from the surface of toner particles and may often invite problems such as fog, deposition on photoconductors and cleaning failure. If such a color toner is used in a two-component developer, it may induce toner deposition on the carrier and may hardly produce images stably in a multiple printing, thus failing to provide good color reproducibility and uniform electrostatic properties.

Releasing Agent

The toner may further comprise, as a releasing agent, a wax immiscible with the binder resins, in addition to the binder resin and colorant. Examples of the wax immiscible with the binder resin are polyolefin wax such as polyethylene wax and polypropylene wax; long-chain hydrocarbon wax such as paraffin wax and Sasol wax; and carbonyl-containing wax. Among them, preferred wax is carbonyl-containing wax. Such carbonyl-containing wax includes, for example, polyalkanoic acid esters such as carnauba wax, trimethylolpropane tribehenate, pentaerythritol tetrabehenate, pentaerythritol diacetate dibehenate, glycerol tribehenate, and 1,18-octadecanediol distearate; polyalkanol esters such as tristearyl trimellitate, and distearyl maleate; polyalkanoic acid amides such as ethylenediaminedibehenamide; polyalkylamides such as tristearylamide trimellitate; and dialkyl ketones such as distearyl ketone. Among these carbonyl-containing waxes, preferred are polyalkanoic acid esters. The wax has a melting point of 40° C. to 160° C., preferably 50° C. to 120° C., and more preferably 60° C. to 90° C. A wax with a melting point of lower than 40° C. may adversely affect the storage stability at high temperatures. In contrast, a wax with a melting point exceeding 160° C. may often invite cold offset upon image fixing at low temperatures. The wax has a melt viscosity of preferably from 5 cps to 1,000 cps, and more preferably from 10 cps to 100 cps as measured at a temperature 20° C. higher than its melting point. A wax with a melt viscosity exceeding 1,000 cps may not satisfactorily contribute to improve hot offset resistance and image-fixing properties at low temperatures. The content of the wax in the toner is generally from 0% to 40% by weight, and preferably from 3% to 30% by weight.

Lubricant

The toner may further comprise a lubricant for appropriately improving the miscibility between the binder resin and the crystalline polyester. As is described above, the toner preferably has an appropriate phase-separation structure comprising the binder resin and the crystalline polyester for effectively exhibiting advantages of the present invention. The miscibility between the binder resin and the crystalline polyester should be a sufficient level to exhibit the functions. By adding a lubricant, the phase-separation structure can be easily formed. The lubricant for use in the present invention can be any of conventional lubricants, as long as it can control the miscibility between the binder resin and the crystalline polyester. Examples are montanic acid wax, montanic ester wax and partially saponified ester wax. Among them, preferred are ethylene glycol montanate wax, glycerol montanate wax, butylene glycol montanate wax, montanate wax partially saponified with calcium hydroxide, aliphatic polyol montanate wax, sodium montanate wax and lithium montanate wax.

Charge Control Agent

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. The amount of the charge control agent is preferably from 0.1 parts by weight to 10 parts by weight, and more preferably from 0.2 parts by weight to 5 parts by weight relative to 100 parts by weight of the binder resin. If the amount is more than 10 parts by weight, the toner may have an excessively high charge, the charge control agent may not sufficiently play its role, the developer may have increased electrostatic attraction to a development roller, may have decreased fluidity or may induce a decreased density of images. The charge control agent may be incorporated into the toner, for example, (1) by melting and kneading with the master batch and the resin to thereby dissolve or disperse the charge control agent therein, (2) by directly added to the organic solvent during the dispersion procedure, or (3) by immobilizing to the surface of prepared toner particles.

Resin Particles

The resin particles can be formed of any known resin, as long as it can form an aqueous dispersion, and can be either a thermoplastic resin or a thermosetting resin. Examples of such resins are vinyl resins, polyurethane resins, epoxy resins, polyester resins, polyamide resins, polyimide resins, silicone resins, phenolic resins, melamine resins, urea resins, aniline resins, ionomer resins, and polycarbonate resins. Each of these resins can be used alone or in combination. Among them, vinyl resins, polyurethane resins, epoxy resins, polyester resins, and mixtures of these resins are preferred in the viewpoint of easy preparation of an aqueous dispersion of spherical resin particles.

Examples of the vinyl resins are homopolymers or copolymers of vinyl monomers, such as styrene-(meth) acrylic ester resins, styrene-butadiene copolymers, (meth) acrylic acid-acrylic ester copolymers, styrene-acrylonitrile copolymers, styrene-maleic anhydride copolymers, and styrene-(meth)acrylic acid copolymers.

External Additive

Inorganic particles can be preferably used as the external additive to improve or enhance the flowability, developing properties, and charging ability of the toner particles. The inorganic particles have a primary particle diameter of preferably from 5 nm to 2 μm, and more preferably from 5 nm to 500 nm and have a specific surface area as determined by the BET method of preferably from 20 $m^2/g$ to 500 $m^2/g$. Examples of the inorganic particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are resin particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these external additives to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) particles, polystyrene particles, and other resin particles prepared by, for example, soap-free emulsion polymerization. Such resin particles preferably have a relatively narrow particle distribution and a volume-average particle diameter of 0.01 μm to 1 μm.

Process for Producing Toner

The binder resin can be prepared, for example, as follow. A polyol (1) and a polycarboxylic acid (2) are heated at the temperature ranging from 150° C. to 280° C. in the presence of a known esterification catalyst such as tetrabutoxy titanate or dibutyltin oxide, and produced water is removed by distillation where necessary under a reduced pressure to thereby yield a hydroxyl-containing polyester. The hydroxyl-containing polyester is allowed to react with a polyisocyanate (3) at the temperature ranging from 40° C. to 140° C. and thereby yields an isocyanate-containing prepolymer (A). The prepolymer (A) is allowed to react with an amine (B) at the temperature ranging from 0° C. to 140° C. and thereby yields a polyester modified with urea bonds. In the reactions between the polyester and the polyisocyanate (3) and between the prepolymer (A) and the amine (B), solvents can be used according to necessity. Examples of solvents for use herein are solvents inert to the isocyanate (PIC) including aromatic solvents such as toluene and xylene; ketones such as acetone, methyl ethyl ketone, and methyl isobutyl ketone; esters such as ethyl acetate; amides such as dimethylformamide and dimethylacetamide; and ethers such as tetrahydrofuran. When the unmodified polyester resin (ii) not modified with urea bonds is used in combination, the unmodified polyester resin (ii) is prepared in the same manner as the hydroxyl-containing polyester, and the prepared unmodified polyester resin (ii) is added to and dissolved in a solution of the modified polyester resin (i) after the completion of the reaction.

The toner of the present invention can be prepared, for example, as follow.

Toner Preparation in Aqueous Medium

Aqueous media for use herein may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone. The resin particles are previously dispersed in the aqueous medium.

The toner particles may be prepared by reacting a dispersion containing the isocyanate-containing prepolymer (A) with the amine (B) in the aqueous medium or prepared by using the previously prepared modified polyester resin (i). They can be prepared, for example, by adding a composition of toner materials such as the modified polyester resin (i) or the prepolymer (A) to the aqueous medium and dispersing the material by action of shear force. The other toner components (hereinafter referred to as "toner materials") such as the coloring agent, coloring agent master batch, releasing agent, charge control agent, and unmodified polyester resin may be mixed with the prepolymer (A) during a dispersing procedure in the aqueous medium for the formation of a dispersion. However, it is preferred that these toner materials are mixed with one another beforehand and the resulting mixture is added to the aqueous medium. The other toner materials such as the coloring agent, the mold release agent, and the charge control agent is not necessarily added during the formation of the particles in the aqueous medium and can be added to the formed particles. For example, particles containing no coloring agent are formed, and the coloring agent is then added to the formed particles according to a known dying procedure.

The dispersing procedure is not specifically limited and includes known procedures such as low-speed shearing, high-speed shearing, dispersing by friction, high-pressure jetting, and ultrasonic dispersion. To allow the dispersion to have an average particle diameter of 2 μm to 20 μm, the high-speed shearing procedure is preferred. When a high-speed shearing dispersing machine is used, the number of rotation is not specifically limited and is from 1,000 to 30,000 rpm and preferably from 5,000 to 20,000 rpm. The dispersion time is not specifically limited and is generally from 0.1 to 5 minutes in a batch system. The dispersing temperature is from 0° C. to 150° C. under a pressure (under a load) and preferably from 40° C. to 98° C. The dispersion is preferably performed at a relatively high temperature for lower viscosity of the dispersion containing the modified polyester resin (i) or the prepolymer (A) and for easier dispersion.

The amount of the aqueous medium is from 50 parts by weight to 2,000 parts by weight, and preferably from 100 parts by weight to 1,000 parts by weight relative to 100 parts by weight of the toner composition containing the modified polyester resin (i) or the prepolymer (A). If the amount is less than 50 parts by weight, the toner composition may not be dispersed sufficiently to thereby fail to yield toner particles having a set average particle diameter. If it exceeds 20,000 parts by weight, it is not economical. Where necessary, a dispersing agent can be used. Such a dispersing agent is preferably used for sharper particle distribution and more stable dispersion.

The modified polyester resin (i) can be prepared from the prepolymer (A) by allowing the prepolymer (A) to react with the amine (B) before dispersing the toner composition in the aqueous medium or by dispersing the prepolymer (A) in the aqueous medium and then adding the amine (B) to react at the particle interface. In this procedure, the urea-modified polyester is formed preferentially in the surface of the prepared toner particles, and the toner particles may have a concentration gradient.

To emulsify and disperse an oil phase containing the dispersed toner composition into a liquid containing water, a dispersing agent is used. Such dispersing agents include, but are not limited to, alkylbenzene sulfonates, α-olefin sulfonates, phosphoric esters, and other anionic surfactants; alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, other quaternary ammonium salts cationic surfactants, and other cationic surfactants; fatty acid amide derivatives, polyhydric alcohol derivatives, and other nonionic surfactants; alanine, dodecyl di(aminoethyl) glycine, di(octylaminoethyl) glycine, N-alkyl-N,N-dimethylammonium betaines, and other amphoteric surfactants.

The effects of the surfactants can be obtained in a small amount by using a surfactant having a fluoroalkyl group. Preferred examples of fluoroalkyl-containing anionic surfactants are fluoroalkylcarboxylic acids each containing 2 to 10 carbon atoms, and metallic salts thereof, disodium perfluorooctanesulfonyl glutamate, sodium 3-[omega-fluoroalkyl (C6–C11) oxy]-1-alkyl (C3–C4) sulfonate, sodium 3-[omega-fluoroalkanoyl (C6–C8)-N-ethylamino]-1-propanesulfonate, fluoroalkyl (C11–C20) carboxylic acids and metallic salts thereof, perfluoroalkyl carboxylic acids (C7–C13) and metallic salts thereof, perfluoroalkyl (C4–C12) sulfonic acids and metallic salts thereof, perfluorooctanesulfonic acid diethanolamide, N-propyl-N-(2-hydroxyethyl) perfluorooctanesulfonamide, perfluoroalkyl (C6–C10) sulfonamide propyl trimethyl ammonium salts, perfluoroalkyl (C6–C10)-N-ethylsulfonyl glycine salts, and monoperfluoroaklyl (C6–C16) ethyl phosphoric esters.

Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, 103, 104, 105, 112, 123A, 123B, 306A, 501, 201 and 204 (from JEMCO Inc.), and FTERGENT F-100 and F-150 (from Neos Co., Ltd.).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl (C6–C10) sulfonamide propyltrimethylammonium salts; benzalkonium salts; benzethonium chloride; pyridinium salts; and imidazolinium salts. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from JEMCO Inc.), and FTERGENT F-300 (from Neos Co., Ltd.).

In addition, an inorganic compound which is slightly soluble in water, tricalcium phosphate, calcium carbonate, titanium oxide, colloidal silica, and hydroxyapatite can be also used as the dispersing agent.

In the preparation of the toner of the present invention a polymeric protective colloid may be employed for stabilizing the primary particles in the dispersion. Examples of such polymer substance for protecting colloid include homopolymers or copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound, such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; vinylpyridine, vinylpyrrolidone, vinylimidazole, ethyleneimine, and other vinyl monomers containing a nitrogen atom or having a nitrogen-containing heterocyclic ring. Examples of the polymer substance also include polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

When calcium phosphate or another dispersion stabilizer that is soluble in acids or bases is used, the dispersion stabilizer is removed from the particles by dissolving the dispersion stabilizer by action of an acid such as hydrochloric acid and washing the particles. Alternatively, the dispersion stabilizer can be removed by, for example, decomposition by action of an enzyme.

When a dispersing agent is used, the dispersing agent may be allowed to remain on the surface of the toner particles but is preferably removed by washing after at least one of elongation reaction or crosslinking reaction from the viewpoint of toner charge properties.

For a lower viscosity of the toner composition and for a sharper particle size distribution of the toner particles, a solvent that can dissolve the modified polyester resin (i) and/or the prepolymer (A) can be used. The solvent is preferably volatile and has a melting point of lower than 100° C. for easier removal. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic hydrocarbon solvents, methylene chloride, 1,2-dichloroethane, chloroform, carbon tetrachloride, and other halogenated hydrocarbons. The amount of the solvent is from 0 to 300 parts by weight, preferably from 0 to 100 parts by weight, and more preferably from 25 parts by weight to 70 parts by weight, relative to 100 parts by weight of the prepolymer (A). The solvent, if any, is removed by heating at atmospheric pressure or under reduced pressure after the elongation and/or crosslinking reaction.

The reaction time between the prepolymer (A) and the amine (B) is appropriately set depending on the reactivity derived from the combination of the isocyanate structure of the polyester prepolymer (A) and the amine (B) and is from 10 minutes to 40 hours and preferably from 2 hours to 24 hours. The reaction temperature is from 0° C. to 150° C. and preferably from 40° C. to 98° C. Where necessary, a known catalyst such as dibutyltin laurate and dioctyltin laurate can be used.

The organic solvent can be removed from the prepared emulsion, for example, by gradually elevating the temperate of the entire system and completely removing the organic solvent in the primary particles by evaporation. Alternatively, it can be removed by spraying the emulsion into a dry atmosphere, thereby completely removing the non-water-soluble organic solvent in the primary particles to thereby form toner particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln. The heating or drying may be carried out at normal pressure or under reduced pressure.

When the particle distribution of the primary particles is wide and the adjustment of the particle distribution is not carried out in the washing and drying process, the particles in the emulsion may be classified.

The particles can be classified by removing particle fractions using a cyclone, decanter or centrifugal separator in a liquid. Although the classification can be carried out on dried particles after drying, it is more preferred that the classification is carried out in a solution, from the viewpoint of efficiency of the process. The obtained irregular toner particles and coarse particles, as a result of the classification, are sent back to the kneading step so as to recycle. In this case, the particles or coarse particles may be in a wet condition.

The dispersing agent is preferably removed from the obtained dispersion, and more preferably removed at the same time of the classification.

The dried toner powder particles may be mixed with finely-divided particles of various agents such as a releasing agent, a charge control agent, a flowability-imparting agent, and a coloring agent. By the application of mechanical impact to the mixture of particles, the finely-divided particles of various agents can be fixedly deposited on the surface of the toner particles or uniformly blended with the toner particles on the surface thereof. Thus, the particles of various agents attached to the surface of the toner particles can be prevented from falling off.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefor include angmill (available from Hosokawa Micron Corporation), a modified I-type mill (available from Nippon Pneumatic MFG., Co., Ltd.) which is reduced pulverizing air pressure, a hybridization system (available from Nara Machine Corporation), Kryptron System (available from Kawasaki Heavy Industries, Ltd.), and an automatic mortar.

Carrier for Two-Component Developer

The toner of the present invention can be used in combination with a carrier in a two-component developer. The amount of the toner in the developer is preferably from 1 part by weight to 10 parts by weight relative to 100 parts by weight of the carrier. Such carrier includes, for example, conventional magnetic particles with a particle diameter of 20 μm to 200 μm, made of iron, ferrite, magnetite, and magnetic resins. Coating materials for use herein include, but are not limited to, amine resins such as urea-formaldehyde resins; melamine resins, benzoguanamine resins, urea resins, polyamide resins, and epoxy resins; polyvinyl and polyvinylidene resins such as acrylic resins, poly(methyl methacrylate) resins, polyacrylonitrile resins, poly(vinyl acetate) resins, poly(vinyl alcohol) resins, poly(vinyl butyral) resins, polystyrene resins, styrene-acrylic copolymer resins, and other styrenic resins; poly(vinyl chloride) and other halogenated olefin resins; poly(ethylene terephthalate) resins, poly(butylene terephthalate) resins, and other polyester resins; polycarbonate resins; polyethylene resins; poly(vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins. The resin for use in the coating material may further comprise a conductive powder according to necessity. Such conductive powders include, for example, powders of metals, carbon black, titanium oxide, tin oxide, and zinc oxide. These conductive powders preferably have an average particle diameter of 1 μm or less. If the average particle diameter is more than 1 μm, the electric resistance of the developer may not sufficiently be controlled.

The toner of the present invention can also be used as a one-component magnetic or non-magnetic developer without using a carrier.

The toner particles may be subjected to solid $C^{13}$-NMR analysis using FT-NMR SYSTEM JNM-AL400 (trade name, a product of JEOL) under the conditions of:

observed nuclide: $C^{13}$,
reference substance: adamantane,
integration times: 8192,
pulse series: CPMAS, IRMOD: IRLEV,
measurement frequency: 100.40 MHz,
OBSET: 134500 Hz,
POINT: 4096,
PD: 7.0 sec,
SPIN: 6088.

Chem Draw Pro Ver. 4.5 can be used as a software for the elucidation of the molecular structure.

The structure of the toner can be verified, for example, in the following manner. Specifically, a resin embedding toner particles is very finely sliced so as to yield an ultrathin section having a thickness of about 100 μm. The toner particles within the ultrathin section are dyed with ruthenium tetroxide. The ultrathin slice is observed under a transmission electron microscope (TEM) at an acceleration voltage of 300 kV at a magnification of about 10,000 times, and pictures of the toner particles are taken and are visually observed.

In the present invention, the molecular weight distribution of the toner or binder resin by gel permeation chromatography (GPC) is determined under the following conditions.

A column is stabilized in a chamber heated at a temperature of 145° C. Then, o-dichlorobenzene containing 0.3% of dibutylhydroxytoluene (BHT) as an eluent is fed through the column at a flow rate of 1 ml/min. Separately, 50 μl to 200 μl of a 0.3% by weight solution of a sample in o-dichlorobenzene at 140° C. is injected into the column and then the measurement is conducted. The measuring apparatus may be 150 CV (trade name, a product of Waters), and the column may be a combination of two or more polystyrene gel columns, which are commercially available typically as Shodex AT and Shodex AT-806 MS from Showa Denko K. K. For measuring the molecular weight of the sample toner, the molecular weight distribution of the sample is calculated from the relationship between the logarithmic value of calibration curve obtained from plural types of monodisperse polystyrene standard samples and the count number with a slice width of 0.05. Examples of the polystyrene standard samples for forming a calibration curve are those having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ commercially available typically from Pressure Chemical Co. or Toyo Soda K.K. Appropriately, at least about ten standard polystyrene samples may be used. For the detection, a refractive index (RI) detector can be used.

In the present invention, the $F_{1/2}$ temperature of a binder resin is measured using an overhead flow tester CFT-500 available from Shimadzu Corp. The conditions of the flow tester are as follows: diameter of the die: 1 mm, pressure applied to the sample: 10 kg/cm$^2$, temperature rising rate: 3° C./minute, the amount of the sample: 1 cm$^2$. The $F_{1/2}$ temperature of a resin is defined as the mid-temperature of the flow starting temperature and the flow ending temperature of the resin when the resin is subjected to a heat analysis using the flow tester.

The glass transition point Tg of a resin is measured with an instrument Rigaku THERMOFLEX TG 8110 available from RIGAKU CORPORATION. The measurements are performed at a temperature rising rate of 10° C./min.

The acid value and hydroxyl value of a resin are measured according to the procedure specified in Japanese Industrial Standards (JIS) K 0070. When a resin sample to be measured is not dissolved in the solvent specified in JIS K0070, a solvent such as dioxane, tetrahydrofuran or o-dichlorobenzene is used.

An X-ray powder diffraction spectrum of a resin is determined using an instrument RINT 1100 available from RIGAKU CORPORATION. The measuring conditions are as follows: target: Cu, voltage/current: 50 kV/30 mA, goniometer: wide angle goniometer.

FIG. 1 is an embodiment of an image forming apparatus according to the present invention. Initially, the schematic configuration of the image forming apparatus will be illustrated. A photoconductor 1 rotates in a counterclockwise direction, is simultaneously uniformly charged by a charger 2 and is then exposed to imagewise light γ using an irradiator (not shown) in an exposing area downstream the charger 2 in its rotation direction. Thus, charges in exposed portions to the imagewise light γ on the photoconductor disappear to thereby form a latent electrostatic image corresponding to the imagewise light γ on the surface of the photoconductor 1.

A developer 3 as a developing unit is arranged downstream the exposing area and houses a toner 4 as a developer. The toner 4 is stirred by a paddle (stirring mechanism) 14 having a convey screw 13, is thereby charged by friction to a predetermined polarity and is conveyed by a developing sleeve 5 to a nip (developing area) between the developing sleeve 5 and the photoconductor 1. The toner 4 conveyed to the developing area is transferred from the developing sleeve 5 to the photoconductor 1 by action of a developing electric field in the developing area formed by developing bias applying means (not shown) and is adhered thereon to thereby form a toner image (visible image) derived from the latent electrostatic image on the photoconductor 1.

The toner image formed on the photoconductor 1 is then transferred to a recording sheet S as a recording material. The recording sheet S has been fed by a resist roller 18 at a nip (transfer area) between a transfer-transport belt 6 and the photoconductor 1. The transfer-transport belt 6 is arranged in the vicinity of the photoconductor 1 downstream the developing device 3 and serves as transferring unit. The toner image on the recording sheet S is fixed by a fixing roller (not shown) as fixing member disposed downstream of the rotating direction of the transfer-transport belt 6. The recording sheet S bearing the fixed image is then ejected onto a paper output tray outside the apparatus main body by delivering means (not shown). The transfer-transport belt 6 is spanned over a bias roller 6*a*.

Toner which is not transferred to the recording sheet S at the transfer area and remained on the photoconductor 1 (residual toner) is removed from the photoconductor 1 by a cleaning blade 7, a recovery spring 8 and a recovery coil 9 of a cleaner. The cleaner serves as a cleaning unit and is disposed downstream of the rotating direction of the photoconductor 1 in the transfer area. Residual electrostatic charge remained on the photoconductor 1 after cleaning the residual toner is eliminated by a charge eliminator 20 comprising, for example, a charge eliminating lamp. FIG. 1 also illustrates a reflection density detecting sensor (P sensor) 16, a toner concentration sensor 17 and a photoconductor-cleaning unit (PCU) 10.

EXAMPLES

The present invention will be illustrated in further detail with reference to several examples below, which are never intended to limit the scope of the present invention. All parts are by weight.

Preparation Example A-1

Preparation of Organic Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.,), 138 parts of styrene, 138 parts of methacrylic acid, 110 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Resin Particle Dispersion A-1] of a vinyl resin (a copolymer of styrene-methacrylic acid-butyl acrylate-sodium salt of sulfuric acid ester of ethylene oxide adduct of methacrylic acid). Particle Dispersion 1 had a volume-average particle diameter of 0.14 μm as determined with a laser diffraction-scattering size distribution analyzer LA-920 (trade name, available from Horiba, Ltd.). Part of Particle Dispersion A-1 was dried to isolate a resin component. The resin component had a Tg of 152° C.

Preparation Example A-2

Preparation of Aqueous Phase

Aqueous Phase A-1 was prepared as an opaque liquid by blending and stirring 990 parts of water, 83 parts of Particle Dispersion A-1, 37 parts of a 48.5% aqueous solution of sodium dodecyl diphenyl ether disulfonate ELEMINOL MON-7 (trade name, available from Sanyo Chemical Industries, Ltd.), and 90 parts of ethyl acetate.

Preparation Example A-3

Preparation of Low-molecular-weight Polyester

In a reactor equipped with a condenser, a stirrer and a nitrogen gas feed tube were placed 229 parts of an ethylene oxide (2 mole) adduct of bisphenol A, 529 parts of a propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 44 parts of trimellitic anhydride at 180° C. at normal atmospheric pressure for 2 hours and thereby yielded Low-molecular Weight Polyester A-1. Low-molecular Weight Polyester A-1 had a number-average molecular weight of 2,500, a weight-average molecular weight of 6,700, a glass transition temperature Tg of 43° C., and an acid value of 25.

Preparation Example A-4-1

Preparation of Polyester Prepolymer

In a reactor equipped with a condenser, a stirrer and a nitrogen gas feed tube were placed 682 parts of ethylene oxide (2 mole) adduct of bisphenol A, 81 parts of a propylene oxide (2 mole) adduct of bisphenol A, 283 parts of terephthalic acid, 22 parts of trimellitic anhydride and 2 parts of dibutyltin oxide. The mixture was reacted at 230° C. at normal atmospheric pressure for 8 hours, was further reacted at a reduced pressure of 10 mmHg to 15 mmHg for 5 hours and thereby yielded Intermediate Polyester A-1 having a number-average molecular weight of 2,100, a weight-average molecular weight of 9,500, a glass transition temperature Tg of 55° C., an acid value of 0.5 and a hydroxyl value of 51.

In a reactor equipped with a condenser, a stirrer and a nitrogen gas feed tube were placed 410 parts of Intermediate Polyester A-1, 89 parts of isophorone diisocyanate and 500 parts of ethyl acetate, followed by reaction at 100° C. for 5 hours to yield Prepolymer A-1 having a free isocyanate content of 1.53% by weight.

Preparation Example A-4-2

Preparation of Crystalline Polyester

In a 5-liter four-neck flask equipped with a nitrogen gas feed tube, a dehydration tube, a stirrer and a thermocouple were placed 25 moles of 1,4-butanediol, 23.75 moles of fumaric acid, 1.65 moles of trimellitic anhydride and 5.3 g of hydroquinone. The mixture was reacted at 160° C. for 5 hours. The temperature was then raised to 200° C. for a reaction for further 1 hour, followed by a reaction at 8.3 kPa for 1 hour, to yield Crystalline Polyester Resin A-1 having a melting point of 119° C., a number-average molecular weight Mn of 710, a weight-average molecular weight Mw of 2,100, an acid value of 24 and a hydroxyl value of 28.

Preparation Example A-4-3, A-4-4, A-4-5 and A-4-6

Crystalline Polyesters 2 to 6 were prepared by the procedure of Preparation Example A-4-2, except for using the following materials.

| Crystalline Polyester A-2 | |
|---|---|
| 1,4-Butanediol | 25 mol |
| Fumaric acid | 1.25 mol |
| Trimellitic anhydride | 5 mol |
| Hydroquinone | 5.7 g |

Crystalline Polyester A-2 had a melting point of 96° C., a number-average molecular weight Mn of 620, a weight-average molecular weight Mw of 1750, an acid value of 37 and a hydroxyl value of 8.

| Crystalline Polyester A-3 | |
|---|---|
| 1,4-Butanediol | 23.75 mol |
| Ethylene glycol | 1.25 mol |
| Fumaric acid | 22.75 mol |
| Trimellitic anhydride | 1.65 mol |
| Hydroquinone | 4.8 g |

Crystalline Polyester A-3 had a melting point of 128° C., a number-average molecular weight Mn of 1650, a weight-average molecular weight Mw of 6400, an acid value of 24 and a hydroxyl value of 44.

| Crystalline Polyester A-4 | |
|---|---|
| 1,4-Butanediol | 22.75 mol |
| Ethylene glycol | 5 mol |
| Fumaric acid | 23.75 mol |
| Trimellitic anhydride | 5 mol |
| Hydroquinone | 5.8 g |

Crystalline Polyester A-4 had a melting point of 82° C., a number-average molecular weight Mn of 1,100, a weight-average molecular weight Mw of 4,700, an acid value of 25 and a hydroxyl value of 33.

| Crystalline Polyester A-5 | |
|---|---|
| 1,4-Butanediol | 25 mol |
| Fumaric acid | 22.5 mol |
| Succinic acid | 1.25 mol |
| Trimellitic anhydride | 1.65 mol |
| Hydroquinone | 5.3 g |

Crystalline Polyester A-5 had a melting point of 113° C., a number-average molecular weight Mn of 780, a weight-average molecular weight Mw of 2,400, an acid value of 22 and a hydroxyl value of 28.

| Crystalline Polyester A-6 | |
|---|---|
| 1,4-Butanediol | 23.75 mol |
| 1,6-Hexanediol | 1.25 mol |
| Fumaric acid | 23 mol |

-continued

| Crystalline Polyester A-6 | |
|---|---|
| Maleic acid | 0.75 mol |
| Trimellitic anhydride | 1.65 mol |
| Hydroquinone | 5.2 g |

Crystalline Polyester A-6 had a melting point of 128° C., a number-average molecular weight Mn of 850, a weight-average molecular weight Mw of 3450, an acid value of 28 and a hydroxyl value of 22.

Preparation Example A-5

Preparation of Ketimine Compound

In a reactor equipped with a stirring rod and a thermometer were placed 170 parts of isophoronediamine and 75 parts of methyl ethyl ketone, followed by reaction at 50° C. for 5 hours to yield Ketimine Compound A-1 having an amine equivalent of 418.

Preparation Example A-6

Preparation of Master Batch (MB)

A total of 1,200 parts of water, 540 parts of carbon black Printex 35 (trade name, available from Degussa AG; DBP oil absorbance: 42 ml/100-mg; pH: 9.5), and 1,200 parts of a polyester resin was mixed in a Mitsui Henschel Mixer (trade name, available from Mitsui Mining Co., Ltd.). The mixture was kneaded at 150° C. for 30 minutes in a two-roll mill, was cold-rolled, was pulverized in a pulverizer and thereby yielded Master Batch A-1.

Preparation Example A-7

Preparation of Oil Phase

In a reactor equipped with a stirring rod and a thermometer were placed 378 parts of Low-molecular Weight Polyester A-1, 110 parts of carnauba wax, 22 parts of a zinc complex of salicylic acid Bontron E-84 (trade name, available from Orient Chemical Industries, Ltd.) as a charge control agent (CCA), and 947 parts of ethyl acetate. The mixture was heated at 80° C. for 5 hours with stirring and was then cooled to 30° C. over 1 hour. The mixture was further treated with 500 parts of Master Batch A-1 and 500 parts of ethyl acetate with stirring for 1 hour and thereby yielded Material Solution A-1.

Next, 1,324 parts of Material Solution A-1 was placed in a vessel, and the carbon black and wax components therein were dispersed using a bead mill (ULTRAVISCO-MILL available from Aimex Co., Ltd.) at a liquid feeding speed of 1 kg/hr, a disc peripheral speed of 6 m/sec., using zirconia beads 0.5 mm in diameter filled 80% by volume. The dispersing procedure was repeated a total of three times. The dispersion was further treated with 1042.3 parts of a 65% solution of Low-molecular Weight Polyester A-1 in ethyl acetate, and the mixture was dispersed under the above conditions, except that the dispersion procedure was performed once, to yield Pigment-wax Dispersion A-1. Pigment-wax Dispersion A-1 had a solid content of 50% as determined by heating the dispersion at 130° C. for 30 minutes.

Preparation Example A-8

Preparation of Crystalline Polyester Dispersion

In a 2-L metallic vessel were placed 100 g of Crystalline Polyester 1 and 400 g of ethyl acetate, the mixture was dissolved or dispersed by heating at 79° C. and was then rapidly cooled on an ice-water bath. The cooled mixture was stirred in a batch-system sand mill (available from Kanpe Hapio Co., Ltd.) for 10 hours using 500 ml of glass beads 3 mm in diameter and thereby yielded Crystalline Polyester Dispersion A-1 having a volume-average particle diameter of 0.4 μm.

Preparation Examples A-9 through A-13

Crystalline Polyester Dispersions 2 to 6 were prepared by the procedure of Preparation Example A-8, except for using following Crystalline Polyesters 2 to 6 instead of Crystalline Polyester A-1.

TABLE 1

| Preparation Example | Crystalline Polyester Dispersion Number | Crystalline Polyester Number | Volume-average particle diameter (μm) |
|---|---|---|---|
| A-9 | 2 | 2 | 0.3 |
| A-10 | 3 | 3 | 0.6 |
| A-11 | 4 | 4 | 1.2 |
| A-12 | 5 | 5 | 0.4 |
| A-13 | 6 | 6 | 2.8 |

Example A-1

Emulsification and Solvent Removal

In a vessel were placed 664 parts of Pigment-wax Dispersion 1, 109.4 parts of Prepolymer 1, 73.9 parts of Crystalline Polyester Dispersion A-1 and 4.6 parts of Ketimine Compound A-1, and the mixture was mixed at 5,000 rpm for 1 minute using a T. K. HOMO MIXER (trade name, available from Tokushu Kika Kogyo Co., Ltd.). Next, the mixture was treated with 1,200 parts of Aqueous Phase A-1 by dispersing at 13,000 rpm for 20 minutes using a T. K. HOMO MIXER and thereby yielded Emulsified Slurry A-1.

Emulsified Slurry A-1 was placed and was heated at 30° C. for 8 hours in a vessel equipped with a stirrer and a thermometer to remove the solvents therefrom. The slurry was aged at 45° C. for 4 hours and thereby yielded Dispersed Slurry A-1.

Washing and Drying

A total of 100 parts of Dispersed Slurry 1 was filtered under a reduced pressure and was washed by the following procedures.

(1) The filtered cake and 100 parts of ion-exchanged water were mixed using a T. K. HOMO MIXER at 12,000 rpm for 10 minutes, and the mixture was filtered.

(2) The filtered cake prepared in (1) and 100 parts of a 10% aqueous solution of sodium hydroxide were mixed using a T. K. HOMO MIXER at 12,000 rpm for 30 minutes, and the mixture was filtered under a reduced pressure.

(3) The filtered cake prepared in (2) and 100 parts of a 10% hydrochloric acid were mixed using a T. K. HOMO MIXER at 12,000 rpm for 10 minutes, and the mixture was filtered.

(4) The filtered cake prepared in (3) and 300 parts of ion-exchanged water were mixed using a T. K. HOMO MIXER at 12,000 rpm for 10 minutes, and the mixture was filtered, wherein this washing procedure was repeated a total of two times to yield Filtered Cake A-1.

Filtered Cake A-1 was dried at 45° C. for 48 hours in a circulating air dryer, was sieved through a 75-μm mesh sieve and thereby yielded Toner Matrix A-1.

Example A-2 through A-6

Toner Matrixes A-2 to A-6 were prepared by the procedure of Example A-1 using 109.4 parts of Prepolymer A-1 and 4.6 parts of Ketimine Compound A-1, except that the weight ratio of (prepolymer)/(low-molecular-weight polyester)/(crystalline polyester) was set as shown below in Table 2.

TABLE 2

| Example Number | Toner Matrix Number | Prepolymer | Low-molecular Weight Polyester | Crystalline Polyester |
|---|---|---|---|---|
| A-2 | A-2 | 5/ | 90/ | 5 |
| A-3 | A-3 | 10/ | 70/ | 20 |
| A-4 | A-4 | 15/ | 60/ | 25 |
| A-5 | A-5 | 20/ | 50/ | 30 |
| A-6 | A-6 | 25/ | 40/ | 35 |

Examples A-7 through A-11

Toner Matrixes A-7 to A-11 were prepared by the procedure of Example A-1, except for using one of Crystalline Polyester Dispersions A-2 to A-6 prepared in Preparation Example A-9 through A-13 instead of Crystalline Polyester Dispersion A-1.

TABLE 3

| Example Number | Toner Matrix Number | Crystalline Polyester Dispersion Number |
|---|---|---|
| A-7 | A-7 | 2 |
| A-8 | A-8 | 3 |
| A-9 | A-9 | 4 |
| A-10 | A-10 | 5 |
| A-11 | A-11 | 6 |

Comparative Example A-1

Toner Matrix A-12 was prepared by the procedure of Example A-1, except that Crystalline Polyester Dispersion A-1 was not used.

| Comparative Example A-2 | |
|---|---|
| Crystalline Polyester 1 | 10 parts |
| Low-molecular Weight Polyester B1 | 70 parts |
| Styrene-methyl Acrylate Resin C1 | 15 parts |
| Polyethylene wax | 5 parts |
| Charge Control Agent (metal salt of salicylic derivative) | 2 parts |
| Colorant (copper phthalocyanine pigment) | 2.5 parts |

Low-molecular Weight Polyester B1 contained no component insoluble in THF and had a weight-average molecular weight Mw of 17,000 and a glass transition point Tg of 59° C. Styrene-methyl Acrylate Resin C1 contained no component insoluble in THF and had a weight-average molecular weight Mw of 15,000 and a glass transition point Tg of 62° C. The polyethylene wax had a melting point of 99° C., a penetration of 1.5 and a solubility parameter SP of 8.1. Styrene-methyl Acrylate Resin C1 showed higher crushability than Low-molecular Weight Polyester B1 and the polyethylene wax.

The above materials were thoroughly mixed in a blender, and the mixture was kneaded using a double-screw extruder. The kneaded product was cooled, pulverized and classified to yield Toner Matrix 13 having a volume-average particle diameter Dv of about 7.5 μm.

To 100 parts of one of above-prepared Toner Matrixes A-1 to A-13 were added 0.7 part of hydrophobic silica and 0.3 part of hydrophobed titanium dioxide in a Henschel mixer, to yield Toners 1 to 13. The physical properties of Toners A-1 to A-13 are shown in Table 4.

A series of developers was prepared by mixing 5% by weight of one of Toners A-1 to A-13 bearing the external additives and 95% by weight of a copper-zinc ferrite carrier coated with a silicone resin and having an average particle diameter of 40 μm. The developer was subjected to continuous printing using imagio Neo 450 (trade name, available from Ricoh Company, Limited). This machine can produce 45 copies of A4-sized sheets per one minute. The properties of the resulting prints and the developers were evaluated according to the following criteria, and the results are shown in Table 5.

Properties (a) Particle Diameter

The particle diameter of a toner was determined using a particle size analyzer Coulter Counter TA II (trade name, available from Beckman Coulter, Inc.) at an aperture of 100 μm, based on which a volume-average particle diameter and a number-average particle diameter were determined.

(b) Sphericity

The sphericity was determined as the sphericity on average by a flow type particle image analyzer FPIA-1000 (trade name, available from Sysmex Corporation). Specifically, the measurement was performed by adding 0.1 ml to 0.5 ml of a surfactant such as an alkylbenzene sulfonate as a dispersing agent to 100 ml to 150 ml of water in a vessel from which solid impurities had been removed, and then adding approximately 0.1 g to 0.5 g of the test sample. The suspension containing the dispersed test sample was subjected to dispersion for approximately 1 minute to 3 minutes by an ultrasonic disperser, and the shape and distribution of the toner particles were determined by the above apparatus at a dispersion concentration of 3,000 particles per microliter to 10,000 particles per microliter.

(c) Charge

The charge was determined by placing 6 g of a developer containing 4.5% by weight to 5.5% by weight of a toner into a sealable metallic cylinder, and blowing.

(d) Thermal Properties (Flow Tester Properties) of Toner

Figure 2A:
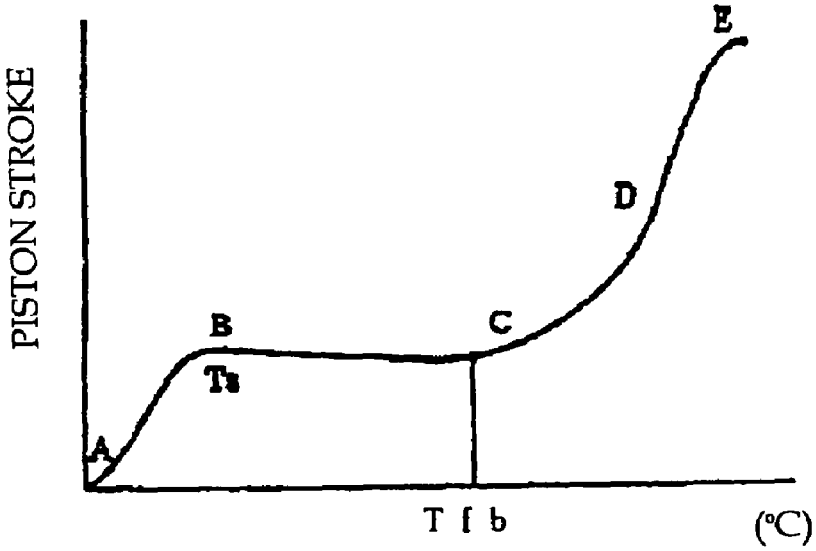
FIGS. 2A and 2B show the piston stroke in flow curves determined with a flow tester, and each respectively shows the relation between the temperature (flow beginning temperature Tfb) and the piston stroke, and the relation between the melting temperature defined by a one-half (½) method.
Figure 2B:
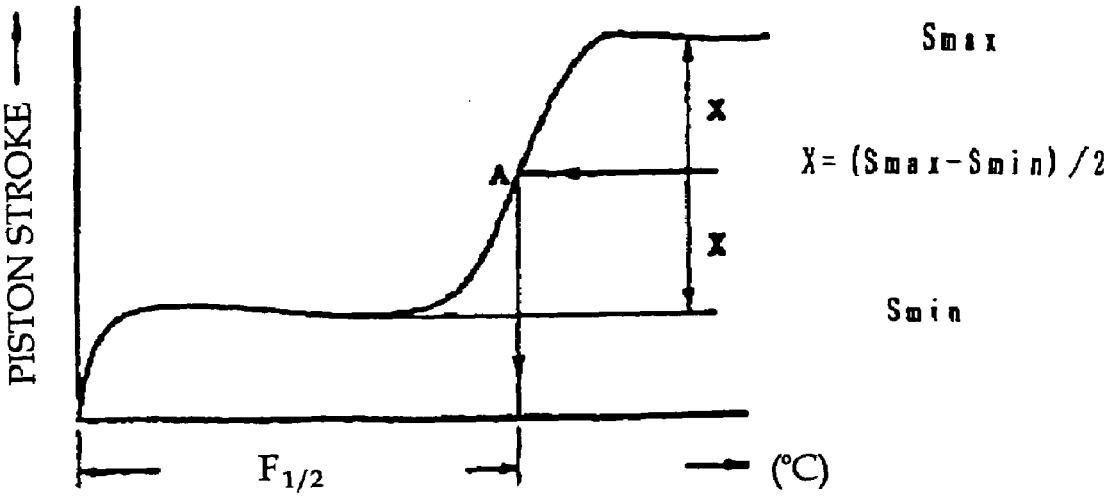

The thermal properties of a toner can be determined using a flow tester such as an overhead Flow Tester CFT 500 (trade name, available from Shimadzu Corporation). Flow curves as determined using this flow tester are shown in FIGS. 2A and 2B, from which temperatures can be read out. In FIGS. 2A and 2B, Ts is the softening temperature (point) and Tfb is the flow beginning temperature (point). The $F_{1/2}$ temperature is a melting temperature (point) determined by the ½ method.

Measurement Conditions

Load: 10 kg/cm$^2$

Temperature rising rate: 3.0° C./min

Die diameter: 0.50 mm

Die length: 10.0 mm (e) Image-Fixing Properties

A solid image was printed on plain paper Type 6200 (trade name, available from Ricoh Company, Limited) and a thick transfer paper Copy Print Paper 135 (trade name, available from NBS Ricoh Co., Ltd.) using imagio Neo 450 (trade name, available from Ricoh Company, Limited) so as to develop a toner in an amount of 1.0±0.1 mg/cm$^2$. In the printing, the temperature of the image-fixing belt was varied. The offset occurring temperature was determined on the plain paper, and the lowest image-fixing temperature was determined on the thick paper.

The lowest fixing temperature (° C.) was defined as a temperature of the fixing roller at which a survival rate of the image density was 70% or more after rubbing the fixed image with a pat.

(f) Image Density

A solid image was printed, and the density of the image was determined with X-Rite spectrodensitometer (trade name, available form X-Rite, Inc.). Five points of each color were determined, and an average was calculated on each color.

(g) Background Deposition

The printer was stopped in the course of development of a blank image. A developer on the photoconductor after development was transferred onto a tape. The difference in image density between the transferred tape and an untransferred tape was determined using a Model 938 spectrodensitometer available from X-Rite, Inc.

(h) Cleaning Ability

Residual toner on the surface of a photoconductor immediately after the cleaning procedure was transferred to a white paper using a Scotch™ Tape (available from Sumitomo 3M Company) and the density was determined using Macbeth reflection densitometer Type RD514. The cleaning ability of the test toner was evaluated as Good when the difference of the measured density and that of a blank tape was 0.01 or less, and as Failure when the difference exceeded 0.01.

(i) Filming

Occurrence of filming of a toner on the developing roller or photoconductor was visually observed. The filming was evaluated according to the following criteria:

Good: no filming

Fair: streak filming

Failure: overall filming

TABLE 4

| | | Toner particle size distribution | | | | Toner thermal properties | | Image-fixing properties | |
|---|---|---|---|---|---|---|---|---|---|
| | Toner Number | Volume-average particle diameter Dv/(μm) | Number-average particle diameter Dn(μm) | Dv/Dn | Toner shape Sphericity | Softening temperature Ts (° C.) | Flow beginning temperature (° C.) | Lowest-image fixing temperature (° C.) | Hot offset occurring temperature (° C.) |
| Example A-1 | 1 | 4.52 | 4.13 | 1.09 | 0.99 | 61 | 95 | 125 | 220° C. or higher |
| Example A-2 | 2 | 5.23 | 4.65 | 1.12 | 0.98 | 58 | 93 | 125 | 220° C. or higher |
| Example A-3 | 3 | 4.38 | 4.01 | 1.09 | 0.99 | 57 | 90 | 120 | 220° C. or higher |
| Example A-4 | 4 | 5.75 | 5.1 | 1.13 | 0.97 | 56 | 88 | 120 | 220° C. or higher |
| Example A-5 | 5 | 4.92 | 4.12 | 1.19 | 0.96 | 55 | 87 | 115 | 220° C. or higher |
| Example A-6 | 6 | 5.51 | 4.89 | 1.13 | 0.98 | 55 | 88 | 115 | 220° C. or higher |
| Example A-7 | 7 | 5.16 | 4.15 | 1.24 | 0.96 | 50 | 81 | 115 | 220° C. or higher |
| Example A-8 | 8 | 4.18 | 3.98 | 1.05 | 0.99 | 63 | 97 | 125 | 220° C. or higher |
| Example A-9 | 9 | 4.89 | 4.15 | 1.18 | 0.98 | 51 | 73 | 115 | 220° C. or higher |
| Example A-10 | 10 | 5.76 | 5.21 | 1.11 | 0.99 | 60 | 93 | 120 | 220° C. or higher |
| Example A-11 | 11 | 5.44 | 4.88 | 1.11 | 0.98 | 64 | 94 | 125 | 220° C. or higher |
| Comp. Ex. A-12 | 12 | 5.69 | 5.16 | 1.10 | 0.99 | 64 | 115 | 150 | 220° C. or higher |
| Comp. Ex. A-13 | 13 | 7.5 | 5.75 | 1.30 | 0.93 | 65 | 97 | 140 | 155° C. |

TABLE 5

| | | Charge (μC/g) | | | Image density | | | Background deposition | | |
|---|---|---|---|---|---|---|---|---|---|---|
| | Toner No. | Initial | after 10,000 copies printing | after 100,000 copies printing | Initial | after 10,000 copies printing | after 100,000 copies printing | Initial | after 10,000 copies printing | after 100,000 copies printing |
| Ex. A-1 | 1 | 32.4 | 31.3 | 30.3 | 1.43 | 1.44 | 1.42 | 0.00 | 0.01 | 0.00 |
| Ex. A-2 | 2 | 31.8 | 30.9 | 29.8 | 1.45 | 1.43 | 1.41 | 0.00 | 0.01 | 0.01 |
| Ex. A-3 | 3 | 29.8 | 29.3 | 28.5 | 1.43 | 1.41 | 1.39 | 0.00 | 0.01 | 0.00 |
| Ex. A-4 | 4 | 32.5 | 31.7 | 31 | 1.45 | 1.42 | 1.4 | 0.00 | 0.00 | 0.01 |
| Ex. A-5 | 5 | 36.4 | 35.5 | 33.4 | 1.41 | 1.4 | 1.4 | 0.00 | 0.01 | 0.01 |
| Ex. A-6 | 6 | 35.1 | 34.2 | 32.7 | 1.46 | 1.45 | 1.43 | 0.01 | 0.00 | 0.00 |
| Ex. A-7 | 7 | 30.8 | 29.9 | 28.5 | 1.43 | 1.41 | 1.41 | 0.00 | 0.01 | 0.01 |
| Ex. A-8 | 8 | 32.3 | 31.5 | 30.1 | 1.44 | 1.42 | 1.41 | 0.00 | 0.00 | 0.00 |
| Ex. A-8 | 9 | 29.6 | 28.8 | 27.5 | 1.43 | 1.41 | 1.41 | 0.01 | 0.01 | 0.01 |
| Ex. A-10 | 10 | 30.5 | 29.1 | 27.9 | 1.42 | 1.43 | 1.41 | 0.00 | 0.01 | 0.00 |

TABLE 5-continued

| | | | | | | | | | | |
|---|---|---|---|---|---|---|---|---|---|---|
| Ex. A-11 | 11 | 31.1 | 30.2 | 28.5 | 1.45 | 1.43 | 1.42 | 0.01 | 0.00 | 0.00 |
| Comp. Ex. A-1 | 12 | 30.6 | 29.5 | 28.3 | 1.42 | 1.39 | 1.32 | 0.01 | 0.13 | 0.27 |
| Comp. Ex. A-2 | 13 | 29.6 | 28.4 | 27.2 | 1.39 | 1.35 | 1.33 | 0.01 | 0.27 | 0.47 |

| | Cleaning ability | | | Filming | | | | |
|---|---|---|---|---|---|---|---|---|
| | Initial | after 10,000 copies printing | after 100,000 copies printing | after 100,000 copies printing | High-temperature storage stability | Low-temperature image-fixing | Hot offset resistance | Assessment |
| Ex. A-1 | Good | Good | Good | Good | Good | Good | Good | Good |
| Ex. A-2 | Good | Good | Good | Good | Good | Good | Good | Good |
| Ex. A-3 | Good | Good | Good | Good | Good | Good | Good | Good |
| Ex. A-4 | Good | Good | Good | Good | Good | Good | Good | Good |
| Ex. A-5 | Good | Good | Good | Good | Good | Good | Good | Good |
| Ex. A-6 | Good | Good | Good | Good | Good | Good | Good | Good |
| Ex. A-7 | Good | Good | Good | Good | Good | Good | Good | Good |
| Ex. A-8 | Good | Good | Good | Good | Good | Good | Good | Good |
| Ex. A-8 | Good | Good | Good | Good | Good | Good | Good | Good |
| Ex. A-10 | Good | Good | Good | Good | Good | Good | Good | Good |
| Ex. A-11 | Good | Good | Good | Good | Good | Good | Good | Good |
| Comp. Ex. A-1 | Fair | Failure | Failure | Fair | Good | Failure | Good | Failure |
| Comp. Ex. A-2 | Good | Fair | Fair | Failure | Good | Good | Failure | Fair |

The toners according to the present invention can be satisfactorily fixed at low temperatures, have satisfactory initial print quality, can stably produce images with good quality in continuous printing, can be cleaned stably and are impervious to filming to photoconductors, developing rollers and other members.

Example B

Preparation of Organic Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.,), 138 parts of styrene, 138 parts of methacrylic acid, 110 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Resin Particle Dispersion B-1] of a vinyl resin (a copolymer of styrene-methacrylic acid-butyl acrylate-sodium salt of sulfuric acid ester of ethylene oxide adduct of methacrylic acid).

Preparation of Aqueous Phase

Aqueous Phase B-1 was prepared as an opaque liquid by blending and stirring 990 parts of water, 80 parts of Particle Dispersion B-1, 40 parts of a 48.5% aqueous solution of sodium dodecyl diphenyl ether disulfonate ELEMINOL MON-7 (trade name, available from Sanyo Chemical Industries, Ltd.), and 90 parts of ethyl acetate.

Preparation of Low-molecular-weight Polyester

In a reactor equipped with a condenser, a stirrer and a nitrogen gas feed tube were placed 220 parts of an ethylene oxide (2 mole) adduct of bisphenol A, 561 parts of a propylene oxide (3 mole) adduct of bisphenol A, 218 parts of terephthalic acid, 48 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 45 parts of trimellitic anhydride at 180° C. at normal atmospheric pressure for 2 hours and thereby yielded Low-molecular Weight Polyester B-1.

Preparation of Prepolymer

In a reactor equipped with a condenser, a stirrer and a nitrogen gas feed tube were placed 682 parts of ethylene oxide (2 mole) adduct of bisphenol A, 81 parts of a propylene oxide (2 mole) adduct of bisphenol A, 283 parts of terephthalic acid, 22 parts of trimellitic anhydride and 2 parts of dibutyltin oxide. The mixture was reacted at 230° C. at normal atmospheric pressure for 8 hours, was further reacted at a reduced pressure of 10 mmHg to 15 mmHg for 5 hours and thereby yielded Intermediate Polyester B-1.

In a reactor equipped with a condenser, a stirrer and a nitrogen gas feed tube were placed 411 parts of Intermediate Polyester B-1, 89 parts of isophorone diisocyanate and 500 parts of ethyl acetate, followed by reaction at 100° C. for 5 hours to yield Prepolymer B-1.

Preparation of Ketimine Compound

In a reactor equipped with a stirring rod and a thermometer were placed 170 parts of isophoronediamine and 75 parts of methyl ethyl ketone, followed by reaction at 50° C. for 5 hours to yield Ketimine Compound B-1.

Preparation of Master Batch

In a reactor equipped with a condenser, stirrer and nitrogen gas feed tube were placed 319 parts of a propylene oxide (2 mol) adduct of bisphenol A, 449 parts of an ethylene oxide (2 mol) adduct of bisphenol A, 243 parts of terephthalic acid, 53 parts of adipic acid and 2 parts of dibutyltin oxide. The mixture was reacted at 230° C. at normal atmospheric pressure for 8 hours, followed by reaction at a reduced pressure of 10 mmHg to 15 mmHg for 5 hours. The reaction mixture was further treated with 7 parts of trimellitic anhydride at 180° C. at normal atmospheric pressure for 2 hours and thereby yielded MB Polyester B-1 (Polyester 1 for Master Batch). A total of 50 parts of C. I. Pigment Blue 15:3, 50 parts of MB Polyester B-1 and 30 parts of water was mixed in a Henschel Mixer. The mixture was kneaded at 150° C. for 45 minutes in a two-roll mill, was cold-rolled, was pulverized in a pulverizer to a diameter of 1 mm and thereby yielded Master Batch B-1.

Example B-1

Preparation Example B-1

In a reactor equipped with a stirring rod and thermometer were placed 257 pats of Low-molecular Weight Polyester B-1, 118.5 parts of Crystalline Polyester CPES 1, 1.5 parts of Montanic Acid Ester Wax B-1 (dropping point: 80° C., acid value: 25 mgKOH/g, density: 1.01 g/cm$^3$), 110 parts of a synthetic ester wax (pentaerythritol tetrabehenate), 22 parts of a zinc complex of salicylic acid Bontron E-84 (trade name, available from Orient Chemical Industries, Ltd.) as a charge control agent (CCA), and 947 parts of ethyl acetate. The mixture was heated at 80° C. for 5 hours with stirring and was then cooled to 30° C. over 1 hour. The mixture was further treated with 500 parts of Master Batch B-1 and 500 parts of ethyl acetate with stirring for 1 hour and thereby yielded Material Solution B-1. Next, 1324 parts of Material Solution B-1 was placed in a vessel, and the pigment and wax components therein were dispersed using a bead mill (ULTRAVISCO-MILL available from Aimex Co., Ltd.) at a liquid feeding speed of 1 kg/hr, a disc peripheral speed of 6 m/sec., using zirconia beads 0.5 mm in diameter filled 80% by volume. The dispersing procedure was repeated a total of three times. The dispersion was further treated with 1,324 parts of a 65% solution of Low-molecular Weight Polyester B-1 in ethyl acetate, and the mixture was dispersed under the above conditions, except that the dispersion procedure was performed once, to yield Dispersion B-1. The properties of Crystalline Polyesters CPES 1 to 5 used in Example B are shown in Tables 6 and 7.

Emulsification and Solvent Removal

In a vessel were placed 648 parts of Dispersion B-1, 100 parts of Prepolymer B-1 and 4.3 parts of Ketimine Compound B-1, and the mixture was mixed at 5,000 rpm for 1 minute using a T. K. HOMO MIXER (trade name, available from Tokushu Kika Kogyo Co., Ltd.). Next, the mixture was treated with 1,200 parts of Aqueous Phase B-1 by dispersing at 13,000 rpm for 20 minutes using a T. K. HOMO MIXER and thereby yielded Emulsified Slurry B-1. Emulsified Slurry 1 was placed in a vessel equipped with a stirrer and a thermometer and was heated at 30° C. for 8 hours to remove the solvents therefrom.

Washing and Drying

A total of 100 parts of Dispersed Slurry B-1 was filtered under a reduced pressure and was washed by the following procedures.

(1) The filtered cake and 100 parts of ion-exchanged water were mixed using a T. K. HOMO MIXER at 12,000 rpm for 10 minutes, and the mixture was filtered.

(2) The filtered cake prepared in (1) and 100 parts of a 10% aqueous solution of sodium hydroxide were mixed with ultrasonic vibration using a T. K. HOMO MIXER at 12,000 rpm for 30 minutes, and the mixture was filtered under a reduced pressure. This ultrasonic alkaline washing procedure was performed again. Namely, the ultrasonic alkaline washing procedure was performed a total of two times.

(3) The filtered cake prepared in (2) and 100 parts of a 10% hydrochloric acid were mixed using a T. K. HOMO MIXER at 12,000 rpm for 10 minutes, and the mixture was filtered.

(4) The filtered cake prepared in (3) and 300 parts of ion-exchanged water were mixed using a T. K. HOMO MIXER at 12,000 rpm for 10 minutes, and the mixture was filtered, wherein this washing procedure was repeated a total of two times to yield Filtered Cake 1. Filtered Cake 1 was dried in a circulating air dryer at 45° C. for 48 hours, was sieved through a 75-μm sieve and thereby yielded toner particles. A total of 100 parts of the toner particles was mixed with 0.5 part of hydrophobic silica and 0.5 part of hydrophobed titanium dioxide in a Henschel mixer and thereby yielded Toner 1.

Example B-2

Toner 2 was prepared by the procedure of Example B-1, except for using Crystalline Polyester CPES2 instead of Crystalline Polyester CPES1.

Example B-3

Toner 3 was prepared by the procedure of Example B-1, except for using Crystalline Polyester CPES2 instead of Crystalline Polyester CPES1.

Example B-4

Toner 4 was prepared by the procedure of Example B-1, except for using a montanic ester wax partially saponified with calcium hydroxide (dropping point: 100° C., acid value 13 mgKOH/g, density: 1.02 g/cm$^3$) instead of Montanic Ester Wax B-1.

Example B-5

Toner 5 was prepared by the procedure of Example B-1, except for using Montanic Ester Wax B-2 (dropping point: 77° C., acid value 15 mgKOH/g, density: 1.00 g/cm$^3$) instead of Montanic Ester Wax B-1.

Example B-6

Toner 6 was prepared by the procedure of Example B-1, except for using a carnauba wax instead of the synthetic ester wax.

Example B-7

Toner 7 was prepared by the procedure of Example B-1, except for using a polyethylene wax instead of Montanic Ester Wax B-1.

Example B-8

Toner 8 was prepared by the procedure of Example B-1, except for using 507 parts of Low-molecular Weight Polyester 1 and 250 parts of C. I. Pigment Blue 15:3 instead of 257 parts of Low-molecular Weight Polyester B-1 and 500 parts of Master Batch B-1.

TABLE 6

Physical Properties of Crystalline Polyester-1

| | F½ (° C.) | Tg (° C.) | Mn<br>Mw | Mw/Mn | Acid value (mgKOH/g) | Hydroxyl value (mgKOH/g) |
|---|---|---|---|---|---|---|
| CPES1 | 128 | 126 | 1,450<br>6,400 | 4.4 | 31.1 | 29.6 |
| CPES2 | 93.8 | 100.3 | 1,310<br>5,700 | 4.4 | 23 | 37.6 |
| CPES3 | 92.8 | 94 | 1,380<br>6,320 | 4.6 | 35.2 | 10.8 |
| CPES4 | 119 | 120 | 1,280<br>6,250 | 4.9 | 49 | 52 |

TABLE 6-continued

Physical Properties of Crystalline Polyester-1

| | F½ (° C.) | Tg (° C.) | Mn Mw | Mw/Mn | Acid value (mgKOH/g) | Hydroxyl value (mgKOH/g) |
|---|---|---|---|---|---|---|
| CPES5 | 125 | 68 | 2,010 6,800 | 3.4 | 35.8 | 38.1 |

TABLE 7

Physical Properties of Crystalline Polyester-2

| | Crystallinity | Estimated molecular formula | Acid component | Alcohol component |
|---|---|---|---|---|
| CPES 1 | yes | yes | maleic acid/ succinic acid | 1,4-butanediol/ 1,6-hexanediol |
| CPES 2 | yes | yes | maleic acid/ succinic acid | 1,4-butanediol/ 1,6-hexanediol |
| CPES 3 | yes | yes | maleic acid/ succinic acid | 1,4-butanediol/ 1,6-hexanediol |
| CPES 4 | yes | yes | maleic acid/succinic acid | 1,4-butanediol/ 1,6-hexanediol |
| CPES 5 | no | no | terephthalic acid/ trimellitic anhydride | ethylene oxide/propylene oxide adduct of bisphenol A |

A sample having the crystallinity was one showing diffraction peaks at least at points of 2θ: 19° to 20°, 21° to 22°, 23° to 25°, and 29° to 31°, in a X-ray diffraction pattern determined with an X-ray powder diffractometer. A sample having the estimated molecular formula was one whose molecular structure of Formula (1) was verified by solid $C^{13}$-NMR.

Comparative Example B-1

Comparative Toner 1 was prepared by the procedure of Example B-1, except for using 257 parts of Low-molecular Weight Polyester 0 part of Crystalline Polyester CPES 1, 60 parts of Montanic Ester Wax B-1 and 170 parts of the synthetic ester wax instead of 257 parts of Low-molecular Weight Polyester B-1, 118.5 parts of Crystalline Polyester CPES 1, 1.5 parts of Montanic Ester Wax B-1 and 110 parts of the synthetic ester wax.

Example B-9

Toner 9 was prepared by the procedure of Example B-1, except for using Crystalline Polyester CPES 4 instead of Crystalline Polyester CPES 1.

Comparative Example B-2

Comparative Toner 2 was prepared by the procedure of Example B-1, except for using Polyester CPES 5 instead of Crystalline Polyester CPES 1.

Example B-10

Toner 10 was prepared by the procedure of Example B-1, except that the mixing using the T. K. HOMO MIXER in the emulsification and solvent removal process was performed at 7,000 rpm for 15 minutes instead of at 3,000 rpm for 20 minutes.

Example B-11

Toner 11 was prepared by the procedure of Example B-1, except that the solvent removal in the emulsification and solvent removal process was performed by air drying instead of heating at 30° C. for 8 hours.

Example B-12

Toner 12 was prepared by the procedure of Example B-1, except that the solvent was removed by heating at 40° C. for 8 hours instead of heating at 30° C. for 8 hours in the emulsification and solvent removal process.

Properties (a) Toner Dispersion

Toner particles embedded a resin were very finely sliced so as to yield an ultrathin section having a thickness of approximately 100 μm. The toner particles within the ultrathin section were dyed with ruthenium tetroxide. Thereafter, the ultrathin section was observed under a transmission electron microscope (TEM) at a magnification of about 10,000 times, and pictures of the toner particles were taken. The pictures were analyzed to determine the presence or absence of a phase-separation structure.

(b) Image-fixing Properties and Hot Offset Resistance

A solid image in an amount of 1.0±0.1 mg/cm$^2$ was printed on Type 6000-70 W Paper (trade name, available from Ricoh Company, Limited) using a full-color copier Preter 550 (trade name, available from Ricoh Company, Limited). The copier had an image fixing device including an image-fixing roller housing a heater and comprising a silicone roller 60 mm in diameter, and a pressure roller comprising a Teflon (trademark) coated silicone roller 60 mm in diameter but an oil application mechanism of the image-fixing device was removed. The image-fixing was performed under the following conditions while varying the temperature of the image-fixing roller, and the cold offset temperature (lowest image-fixing temperature) and hot offset occurring temperature (hot offset preventing temperature) were determined.

Linear velocity of image-fixing device: 180±2 mm/sec

Image-fixing nip width: 10±1 mm

Criteria of the properties are as follows.

(1) Lowest Image-fixing Temperature (5 levels)

A: lower than 130° C.

B: 130° C. or higher and lower than 140° C.

C: 140° C. or higher and lower than 150° C.

D: 150° C. or higher and lower than 160° C.

E: 160° C. or higher (2) Hot Offset Resistance (5 levels)

A: higher than 200° C.

B: 200° C. or lower and higher than 190° C.

C: 190° C. or lower and higher than 180° C.

D: 180° C. or lower and higher than 170° C.

E: 170° C. or lower (c) High-temperature Storage Stability

A sample toner was placed in a glass vessel, the glass vessel was left stand in a thermostat at 50° C. for 24 hours. The toner was cooled to 24° C., and the depth of penetration of the sample toner was determined according to the penetration test specified in JIS K 2235-1991. With an increasing penetration, the high-temperature storage stability of the toner was rated good. If the penetration is 5 mm or less, problems in practical use may occur.

A: The needle fully penetrated.

B: The penetration was 25 mm or more.

C: The penetration was 20 mm or more and less than 25 mm.

D: The penetration was 15 mm or more and less than 20 mm.

E: The penetration was less than 15 mm.

(d) Particle Diameter

The particle diameter of a toner was determined using a particle size analyzer Coulter Counter TA II (trade name, available from Beckman Coulter, Inc.) at an aperture of 100 μm, based on which a volume-average particle diameter and a number-average particle diameter were determined.

(e) Sphericity

The sphericity was determined as the sphericity on average by a flow type particle image analyzer FPIA-1000 (trade name, available from Sysmex Corporation). Specifically, the measurement was performed by adding 0.1 ml to 0.5 ml of a surfactant such as an alkylbenzene sulfonate as a dispersing agent to 100 ml to 150 ml of water in a vessel from which solid impurities had been removed, and then adding approximately. 0.1 g to 0.5 g of the test sample. The suspension containing the dispersed test sample was subjected to dispersion for approximately 1 minute to 3 minutes by an ultrasonic disperser, and the shape and distribution of the toner particles were determined by the above apparatus at a dispersion concentration of 3,000 particles per microliter to 10,000 particles per microliter.

(f) Haze

A monochromatic solid image sample was printed on an OHP sheet Type PPC-DX (trade name, available from Ricoh Company, Limited) using a copier imagio Neo 450 (trade name, available from Ricoh Company, Limited) at a surface temperature of image-fixing belt of 160° C. The copier was adjusted so that a toner was developed in an amount of 1.0±0.1 mg/cm$^2$. The haze of the image sample was determined using a direct-reading Haze Computer HGM-2DP (trade name, available from Suga Test Instruments).

The haze is also referred to as "degree of cloudiness" and is determined as an index of the transparency of toner. With a decreasing haze, the toner has a higher transparency and shows better color development in an OHP sheet. The haze is preferably 30% or less and more preferably 20% or less for satisfactory color development.

(g) Diameter of Dispersed Pigment in Toner

Ultrathin sections of a sample toner were prepared, and a sectional photograph of the toner was taken using a transmission electron microscope H-9000H (trade name, available from Hitachi, Ltd.) at a magnification of 100,000 times. Based on the photograph, 100 pigment particles were selected at random, the diameters of the pigment particles were determined, and the average thereof was calculated. The diameter of one dispersed particle is defined as the average of the maximum diameter and the minimum diameter. When particles aggregated, the resulting aggregate was taken as one particle.

(h) Image Graininess

A monochromatic photographic image was printed, and the graininess of the image was evaluated by visual observation.

(i) Fog

A chart image with an image occupancy of 5% was continuously outputted on 50,000 sheets using a toner and using a modified machine of Ipsio Color 8000 (trade name, available from Ricoh Company, Limited). Thereafter, the deposition of the toner on the background of images on the sheet was visually evaluated.

The results are shown below.

TABLE 8

| | Phase separation structure | Low-temperature image-fixing properties | Hot offset resistance | High-temperature storage stability |
|---|---|---|---|---|
| Example B-1 | yes | B | B | A |
| Example B-2 | yes | A | A | B |
| Example B-3 | yes | B | B | B |
| Example B-4 | yes | B | B | B |
| Example B-5 | yes | B | B | B |
| Example B-6 | yes | B | C | B |
| Example B-7 | yes | B | C | C |
| Example B-8 | yes | A | A | B |
| Comp. Ex. B-1 | no | E | E | C |
| Example B-9 | yes | D | D | C |
| Comp. Ex. B-2 | yes | D | D | D |
| Example B-10 | yes | A | A | B |
| Example B-11 | yes | A | A | B |
| Example B-12 | yes | A | A | B |

A sample of toner having a phase-separation structure was one in which the phase-separation structure was verified by transmission electron microscopic observation of the section of toner.

TABLE 9

| | Pigment dispersion | | Particle diameter | | | | | | |
|---|---|---|---|---|---|---|---|---|---|
| | Diameter of dispersed particle (μm) | Percent by number of particles of 0.7 μm or more (μm) | Dv (μm) | Dn (μm) | Dv/Dn | Average sphericity | Haze (%) | Graininess | Fog |
| Example 1 | 0.48 | 3.8 | 6.3 | 5.1 | 1.23 | 0.952 | 20 | B | B |
| Example 2 | 0.49 | 4.0 | 5.5 | 4.9 | 1.12 | 0.959 | 25 | A | B |
| Example 3 | 0.32 | 2.8 | 6.8 | 5.7 | 1.20 | 0.948 | 24 | B | B |
| Example 4 | 0.39 | 3.5 | 6.2 | 5.2 | 1.19 | 0.945 | 21 | B | B |
| Example 5 | 0.43 | 4.1 | 7.0 | 5.6 | 1.24 | 0.939 | 23 | B | B |
| Example 6 | 0.38 | 2.1 | 4.6 | 4.2 | 1.10 | 0.948 | 19 | A | B |
| Example 7 | 0.45 | 3.5 | 5.9 | 4.8 | 1.22 | 0.939 | 21 | A | B |
| Example 8 | 0.54 | 6.0 | 6.4 | 5.3 | 1.21 | 0.943 | 40 | B | C |
| Comp. Ex. 1 | 0.35 | 2.7 | 5.7 | 4.6 | 1.24 | 0.947 | 24 | A | B |
| Example 9 | 0.46 | 3.8 | 6.0 | 5.0 | 1.19 | 0.948 | 20 | B | B |
| Comp. Ex. 2 | 0.41 | 4.1 | 6.3 | 5.3 | 1.18 | 0.945 | 28 | B | B |
| Example 10 | 0.33 | 2.2 | 8.2 | 6.3 | 1.30 | 0.924 | 22 | B | B |

TABLE 9-continued

| | Pigment dispersion | | Particle diameter | | | | | | |
|---|---|---|---|---|---|---|---|---|---|
| | Diameter of dispersed particle (μm) | Percent by number of particles of 0.7 μm or more (μm) | Dv (μm) | Dn (μm) | Dv/Dn | Average sphericity | Haze (%) | Graininess | Fog |
| Example 11 | 0.37 | 3.3 | 8.7 | 6.2 | 1.41 | 0.891 | 21 | C | C |
| Example 12 | 0.43 | 4.8 | 5.9 | 4.8 | 1.22 | 0.889 | 26 | C | B |

The present invention provides toners for electrostatic development which can be satisfactorily fixed at low temperatures without deteriorating satisfactory high-temperature storage stability and have sufficient hot offset resistance.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner for electrostatic development comprising:

toner particles, each toner particle comprising:

a binder resin comprising a modified polyester resin and a crystalline polyester resin; and a colorant, wherein the toner particles are obtained by a process comprising the steps of:

subjecting a modified polyester prepolymer containing at least an isocyanate or epoxy group to at least one of dissolving and dispersing in an organic solvent to yield a solution or dispersion, wherein the modified polyester resin results from reaction of the modified polyester prepolymer with a compound having an active hydrogen group;

mixing the solution or dispersion with an aqueous medium comprising resin particles; and subjecting the modified polyester resin to at least one of crosslinking and elongation in the aqueous medium.

2. A toner for electrostatic development according to claim 1, wherein the binder resin comprises:

the modified polyester resin (i), an unmodified polyester resin (ii), and the crystalline polyester resin (iii), wherein the weight ratio of the modified polyester resin (i) to the total of the unmodified polyester resin (ii) and the crystalline polyester resin (iii) is from 5:95 to 25:75, and wherein the weight ratio of the unmodified polyester resin (ii) to the crystalline polyester resin (iii) is from 99:1 to 50:50.

3. A toner for electrostatic development according to claim 1, wherein the toner has a glass transition point Tg of 40° C. to 70° C.

4. A toner for electrostatic development according to claim 1, wherein the toner has a flow beginning temperature Tfb of 70° C. to 150° C.

5. A toner for electrostatic development according to claim 1, wherein the toner particles have a volume-average particle diameter of 4 μm to 8 μm.

6. A toner for electrostatic development according to claim 1, wherein the toner particles have a volume-average particle diameter Dv and a number-average particle diameter Dn, and wherein the ratio Dv/Dn of Dv to Dn is from 1.00 to 1.25.

7. A toner for electrostatic development according to claim 1, wherein the toner particles have an average sphericity of 0.95 to 0.99.

8. A toner for electrostatic development according to claim 1, wherein, in a molecular weight distribution of tetrahydrofuran (THF)-soluble components of the polyester resins in the toner, the peak molecular weight is 1,000 to 30,000, the content of a component having a molecular weight of 30,000 or more is 1% by volume to 80% by volume, and the number-average molecular weight is from 2,000 to 15,000.

9. A toner for electrostatic development according to claim 8, wherein, in a molecular weight distribution of tetrahydrofuran (THF) soluble components of the polyester resins in the toner, the content of a component having a molecular weight of 1,000 or less is from 0.1% by volume to 5.0% by volume.

10. A toner for electrostatic development according to claim 8, wherein the content of tetrahydrofuran-insoluble components in the polyester resins in the toner is from 1% by volume to 15% by volume.

11. A toner for electrostatic development according to claim 1, wherein the resin particles have a volume-average particle diameter of 5 nm to 500 nm.

12. A toner for electrostatic development according to claim 1, wherein the toner particle further comprises a releasing agent, wherein the releasing agent is a wax immiscible with the binder resin.

13. A toner for electrostatic development according to claim 12, wherein the wax is a polyalkanoic acid ester.

14. A toner for electrostatic development according to claim 1, the toner particle further comprising a lubricant, wherein the lubricant is capable of controlling the miscibility of the crystalline polyester resin with the other components in the binder resin.

15. A toner for electrostatic development according to claim 14, wherein the lubricant is at least one selected from the group consisting of montanic acid wax, montanic ester wax and partially saponified ester wax.

16. A toner for electrostatic development according to claim 1, wherein the toner particle further comprises a charge control agent.

17. A toner for electrostatic development according to claim 1, wherein the crystalline polyester resin is dispersed in the toner particle wherein the dispersed particle of the crystalline polyester resin has a major axis of 0.2 μm to 3.0 μm.

18. A toner for electrostatic development according to claim 1, wherein the crystalline polyester resin has an endothermic peak temperature in differential scanning calorimetry (DSC) of 50° C. to 150° C.

19. A toner for electrostatic development according to claim 1, wherein, in a molecular weight distribution of o-dichlorobenzene-soluble component in the crystalline polyester resin determined by gel permeation chromatography (GPC), the o-dichlorobenzene-soluble component has a weight-average molecular weight Mw of 1,000 to 6,500, a number-average molecular weight Mn of 500 to 2,000, and a ratio Mw/Mn of Mw to Mn of 2 to 5.

20. A toner for electrostatic development according to claim 19, wherein the weight-average molecular weight Mw is 5,500 to 6,500, the number-average molecular weight Mn is 1,300 to 1,500, and the ratio Mw/Mn is from 2 to 5.

21. A toner for electrostatic development according to claim 1, wherein the crystalline polyester resin is represented by following Formula (1):

$$-[O-CO-CR_1=CR_2-CO-O-(CH_2)_n]- \quad (1)$$

wherein $R_1$ and $R_2$ are each a hydrocarbon group having 1 to 20 carbon atoms.

22. A toner for electrostatic development according to claim 1, wherein the crystalline polyester resin comprises an alcohol component and an acid component, wherein the alcohol component comprises a diol compound having 2 to 6 carbon atoms and the acid component comprises at least one selected from the group consisting of maleic acid, fumaric acid, succinic acid and derivatives thereof.

23. A toner for electrostatic development according to claim 22, wherein the alcohol component comprises at least one selected from the group consisting of 1,4-butanediol, 1,6-hexanediol and derivatives thereof.

24. A toner for electrostatic development according to claim 1, wherein the crystalline polyester resin has a glass transition point Tg of 30° C. to 130° C. and a $F_{1/2}$ temperature of 60° C. to 130° C.

25. A toner for electrostatic development according to claim 1, wherein the crystalline polyester resin has an acid value of 20 mgKOH/g to 45 mgKOH/g.

26. A toner for electrostatic development according to claim 1, wherein the crystalline polyester resin has a hydroxyl value of 5 mgKOH/g to 50 mgKOH/g.

27. A toner for electrostatic development according to claim 1, wherein the crystalline polyester resin shows diffraction peaks at least at points of 2θ of 19° to 20°, 21° to 22°, 23° to 25°, and 29° to 31° in an X-ray diffraction pattern determined with an X-ray powder diffractometer.

28. A toner for electrostatic development according to claim 1, wherein the modified polyester resin is a modified polyester resin capable of having a urea bond.

29. A toner for electrostatic development according to claim 1, wherein the process further comprises a step of removing the organic solvent with an application of at least one of reduced pressure and heat.

30. A toner for electrostatic development according to claim 1, wherein the process further comprises the steps of subjecting the crystalline polyester resin to at least one of dissolving and dispersing in an organic solvent as particles having a volume-average particle diameter of 0.2 μm to 3 μm to yield a dispersion; and mixing the dispersion with the aqueous medium together with the modified polyester resin.

31. A toner for electrostatic development according to claim 1, wherein the process further comprises the steps of dissolving or dispersing the colorant in an organic solvent to yield a solution or dispersion, and mixing the solution or dispersion with the aqueous medium together with the modified polyester resin.

32. A toner for electrostatic development according to claim 31, wherein the process further comprises the steps of kneading the colorant and at least part of the binder resin with water to yield a composition; dissolving or dispersing the composition in an organic solvent to yield a solution or dispersion; and mixing the solution or dispersion with the aqueous medium.

33. A toner for electrostatic development according to claim 1, wherein the colorant is dispersed in the toner particles as particles having a number-average particle diameter of 0.5 μm or less, and wherein the content of colorant particles having a number-average particle diameter of 0.7 μm or more is 5% by number or less.

34. A toner for electrostatic development according to claim 2, wherein the unmodified polyester resin (ii) has a glass transition point Tg of 40° C. to 80° C.

35. A toner for electrostatic development according to claim 2, wherein the unmodified polyester resin (ii) has a weight-average molecular weight of 2,000 to 90,000.

36. A toner for electrostatic development according to claim 12, wherein the wax has a melting point of 40° C. to 160° C.

37. A toner for electrostatic development according to claim 1, wherein the toner particle comprises an external additive, the external additive comprising at least one of inorganic particles and resin particles.

38. A process for producing a toner for electrostatic development, comprising the steps of:

mixing an aqueous medium comprising resin particles with:

(1) an organic solvent comprising a modified polyester prepolymer containing at least an isocyanate or epoxy group being subjected to at least one of dissolving and dispersing therein wherein a modified polyester resin results from reaction of the modified polyester prepolymer with a compound having an active hydrogen group, (2) an organic solvent comprising a crystalline polyester resin dispersed therein as particles having a volume-average particle diameter of 0.2 μm to 3 μm, and (3) an organic solvent comprising a colorant dissolved or dispersed therein;

subjecting the modified polyester resin to at least one of crosslinking and elongation in the aqueous medium; and removing the organic solvents, wherein the toner comprises a binder resin and the colorant, and wherein the binder resin comprises the modified polyester resin and a crystalline polyester resin.

39. A one-component developer comprising:

a toner, wherein the toner comprises toner particles, each toner particle comprising:

a binder resin comprising a modified polyester resin and a crystalline polyester resin; and a colorant, wherein the toner particles are obtained by a process comprising the steps of:

subjecting a modified polyester prepolymer containing at least an isocyanate or epoxy group to at least one of dissolving and dispersing in an organic solvent to yield a solution or dispersion, the modified polyester resin is a result of reaction of the modified polyester prepolymer with a compound having an active hydrogen group;

mixing the solution or dispersion with an aqueous medium comprising resin particles, and subjecting the modified polyester resin to at least one of crosslinking and elongation in the aqueous medium.

40. A two-component developer comprising:

a carrier; and a toner, the toner comprising toner particles, each toner particle comprising:

a binder resin comprising a modified polyester resin and a crystalline polyester resin; and a colorant, wherein the toner particles are obtained by a process comprising the steps of:

subjecting a modified polyester prepolymer containing at least an isocyanate or epoxy group to at least one of dissolving and dispersing in an organic solvent to yield a solution or dispersion, wherein the modified polyester resin results from reaction of the modified polyester prepolymer with a compound having an active hydrogen group;

mixing the solution or dispersion with an aqueous medium comprising resin particles, and subjecting the modified polyester resin to at least one of crosslinking and elongation in the aqueous medium.

41. A container for a developer, comprising:

a developer housed in the container, wherein the developer comprises a toner, the toner comprising toner particles each comprising:

a binder resin comprising a modified polyester resin and a crystalline polyester resin; and a colorant, wherein the toner particles are obtained by a process comprising the steps of:

subjecting a modified polyester prepolymer containing at least an isocyanate or epoxy group to at least one of dissolving and dispersing in an organic solvent to yield a solution or dispersion, wherein the modified polyester resin results from reaction of the modified polyester prepolymer with a compound having an active hydrogen group;

mixing the solution or dispersion with an aqueous medium comprising resin particles, and subjecting the modified polyester resin to at least one of crosslinking and elongation in the aqueous medium.

42. An image forming process comprising the steps of:

charging a photoconductor;

irradiating the photoconductor with imagewise light to form a latent electrostatic image;

developing the latent electrostatic image with a toner to form a toner image;

transferring the toner image from the photoconductor to a recording material; and heating and pressing the transferred image with a fixing member to fix the image on the recording material, wherein the fixing member is at least one of a roller and a belt, and wherein the toner is a toner for electrostatic development, the toner comprising toner particles, each toner particle comprising:

a binder resin comprising a modified polyester resin and a crystalline polyester resin; and a colorant, wherein the toner particles are obtained by a process comprising the steps of:

subjecting a modified polyester prepolymer containing at least an isocyanate or epoxy group to at least one of dissolving and dispersing in an organic solvent to yield a solution or dispersion, wherein the modified polyester resin results from reaction of the modified polyester prepolymer with a compound having an active hydrogen group;

mixing the solution or dispersion with an aqueous medium comprising resin particles, and subjecting the modified polyester resin to crosslinking and/or elongation in the aqueous medium.

* * * * *